US008167125B2

(12) United States Patent
Kim

(10) Patent No.: US 8,167,125 B2
(45) Date of Patent: May 1, 2012

(54) TRANSPARENT BOX AND ARRANGEMENT OF ARTICLES OF CLOTHING THEREIN

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 396 days.

(21) Appl. No.: 12/497,579

(22) Filed: Jul. 3, 2009

(65) Prior Publication Data

US 2010/0025269 A1 Feb. 4, 2010

Related U.S. Application Data

(60) Provisional application No. 61/078,139, filed on Jul. 3, 2008.

(51) Int. Cl.
*B65D 85/18* (2006.01)

(52) U.S. Cl. ..... 206/278; 206/292; 206/769; 206/297; 206/294; 229/87.15; 229/87.17; 229/120.37

(58) Field of Classification Search ..... 206/278, 206/292, 769, 297, 294; 229/87.15, 87.17, 229/120.37

See application file for complete search history.

(56) References Cited

U.S. PATENT DOCUMENTS

| | | | | | |
|---|---|---|---|---|---|
| 698,266 | A | | 4/1902 | Elliott | |
| 982,948 | A | | 1/1911 | Griesemer | |
| 1,253,457 | A | | 1/1918 | Atkinnson | |
| 1,320,933 | A | * | 11/1919 | Schoenfeld | 206/292 |
| 1,535,102 | A | * | 4/1925 | Cohn | 206/294 |
| 1,862,353 | A | | 6/1932 | Allison | |
| 1,995,864 | A | | 3/1935 | Reinhold | |
| 2,063,255 | A | | 12/1936 | Madsen et al. | |
| 2,093,830 | A | | 9/1937 | Flatley | |
| 2,233,207 | A | | 2/1941 | Gillam | |
| 2,513,755 | A | * | 7/1950 | Smith | 206/294 |
| 2,524,345 | A | * | 10/1950 | Essman | 206/294 |
| 2,608,292 | A | * | 8/1952 | Stensgaard | 206/288 |
| 2,907,045 | A | | 10/1959 | O'Reilly | |
| 3,043,494 | A | | 7/1962 | Moore | |

(Continued)

OTHER PUBLICATIONS

U.S. Appl. No. 12/171,574, filed Jul. 11, 2008, Kim.

(Continued)

*Primary Examiner* — Tri Mai
(74) *Attorney, Agent, or Firm* — Leason Ellis LLP

(57) ABSTRACT

In one embodiment, a retail display includes a first box having walls that define a first interior compartment. The walls include a top wall that is formed of a transparent material to permit viewing of the first interior compartment. The display also includes an inner box that is open along a top thereof and is disposed within the first interior compartment. The inner box partitions the interior compartment into a first section and a second section where the inner box is disposed. The inner box has a second interior compartment. The retail display includes a first article of clothing disposed within the first section, wherein the degree of movement of the first article of clothing is limited by walls of the first box and the vertical side wall of the inner box. A second article of clothing is disposed within the second interior compartment of the inner box. An aperture is formed in the top wall of the first box and positioned so that it extends across the vertical side wall of the inner box and allows access to both the first and second interior compartments to permit contact with both the first and second articles of clothing.

8 Claims, 19 Drawing Sheets

U.S. PATENT DOCUMENTS 3,060,448 A 10/1962 Mongelli
3,066,792 A 12/1962 Spilman
3,308,935 A 3/1967 Cole
3,346,881 A 10/1967 Mathison
3,363,264 A 1/1968 Mathison
3,506,978 A 4/1970 Santona
3,511,364 A 5/1970 Airdo
3,670,881 A 6/1972 Dutcher
3,890,678 A 6/1975 Leonard
3,964,105 A 6/1976 Gideon
3,999,222 A 12/1976 Walborn
4,046,253 A 9/1977 Weaver
4,173,792 A 11/1979 Intengan
4,182,224 A 1/1980 Dutcher
D261,479 S 10/1981 Marks
4,546,494 A 10/1985 Garber
4,590,610 A 5/1986 Rhyne
4,667,346 A 5/1987 Strollo
4,762,272 A 8/1988 Herrin
4,856,709 A 8/1989 Axelsson et al.
4,933,991 A 6/1990 Love
5,002,220 A 3/1991 Safranski
D343,356 S 1/1994 Wittman
D346,960 S 5/1994 Bennett
5,316,139 A 5/1994 Judd et al.
D349,181 S 8/1994 Cheng
5,499,484 A 3/1996 Herrin
D368,588 S 4/1996 Goraleski et al.
5,549,243 A 8/1996 Dorier et al.
5,673,434 A 10/1997 Risk
D390,339 S 2/1998 Dipietro
5,774,893 A 7/1998 Torres
6,041,998 A 3/2000 Goldberg et al.
6,102,279 A 8/2000 Dowd
6,126,000 A 10/2000 Tung
6,142,365 A 11/2000 Breitbach
6,460,189 B1 10/2002 Welch
6,499,590 B1 12/2002 Godshaw et al.
D492,595 S 7/2004 Chang
6,901,636 B2 6/2005 Kim
6,978,518 B2 12/2005 Kim
7,096,509 B2 8/2006 Kim
7,114,220 B2 10/2006 Kim
D546,674 S 7/2007 Limber
D553,495 S 10/2007 Vandecasteele et al.
7,310,857 B2 12/2007 Kim
D565,965 S 4/2008 Kim
D565,966 S 4/2008 Kim
D574,722 S 8/2008 Kim
D574,723 S 8/2008 Kim
D574,724 S 8/2008 Kim
D574,725 S 8/2008 Kim
D574,726 S 8/2008 Kim
D574,727 S 8/2008 Kim
D574,728 S 8/2008 Kim
D574,729 S 8/2008 Kim
D574,730 S 8/2008 Kim
D589,364 S 3/2009 Kim
D589,365 S 3/2009 Kim
D589,366 S 3/2009 Kim
D589,367 S 3/2009 Kim
D590,724 S 4/2009 Kim
D590,725 S 4/2009 Kim
D590,726 S 4/2009 Kim
D593,872 S 6/2009 Kim
D593,873 S 6/2009 Kim
D595,151 S * 6/2009 Kim ..... D9/721
2006/0010560 A1 1/2006 Kim
2007/0062846 A1 3/2007 Kim

OTHER PUBLICATIONS

U.S. Appl. No. 29/318,283, filed May 16, 2008, Kim.
U.S. Appl. No. 29/320,041, filed Jun. 19, 2008, Kim.
U.S. Appl. No. 29/326,598, filed Oct. 21, 2008, Kim.
U.S. Appl. No. 29/325,199, filed Sep. 26, 2006, Kim.
U.S. Appl. No. 29/325,881, filed Sep. 26, 2008, Kim.

* cited by examiner

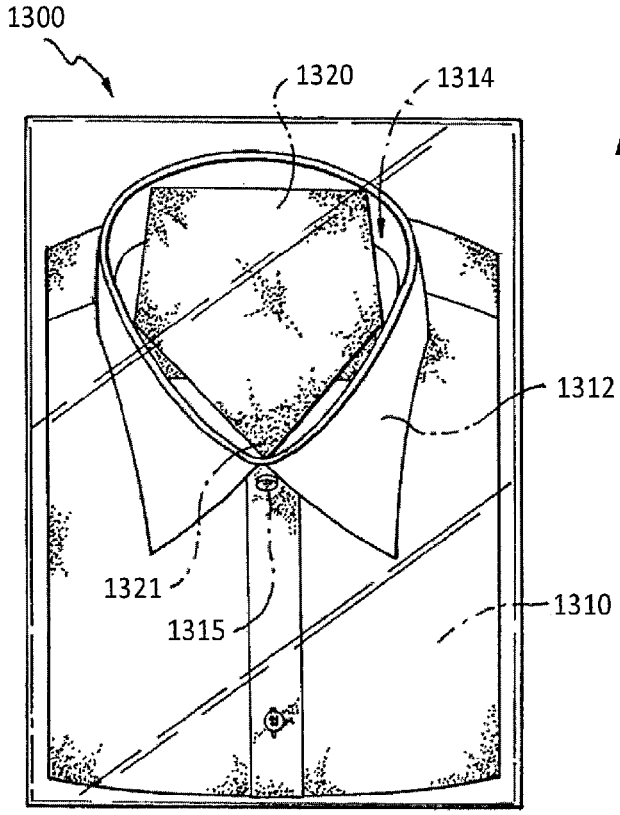
Fig. 23
Fig. 24
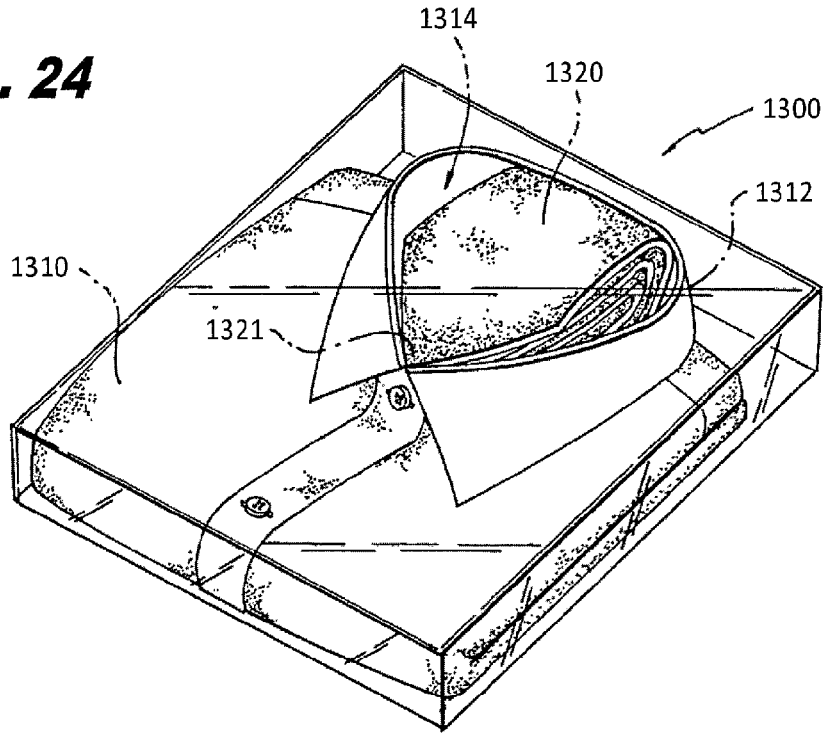

TRANSPARENT BOX AND ARRANGEMENT OF ARTICLES OF CLOTHING THEREIN

CROSS-REFERENCE TO RELATED APPLICATION

The present application claims the benefit of U.S. patent application Ser. No. 61/078,139, filed Jul. 3, 2008, which is hereby incorporated by reference in its entirety.

TECHNICAL FIELD

The present invention relates to retail packaging and in particular, to a box for displaying arrangements of articles of clothing.

BACKGROUND

In the retail sale of dress shirts and dress shirts and tie combinations, it is desirable to present the merchandise in a manner that permits potential customers to have a good look at the product. On the other hand, it is important for retailers to keep the product clean and free of any soil or stains that may result from handling, to protect against theft, and to maintain the shirts in an orderly and well-folded condition so that their displays remains attractive to passers by.

It is also desirable that the packaging that is used be economical to manufacturer, that it be made from a recyclable material, and that it be made with minimal waste.

It is also desirable to have a packaging that addresses the foregoing needs and which permits shirts to be stacked in great number to promote efficient shelf and display space usage.

It is also desirable to allow a consumer to access the quality of the product by having limited, controlled contact with the product to dissuade the consumer from opening the package at one of its ends in order to gain access.

The present invention satisfies these and other needs.

SUMMARY

In one embodiment, a retail display includes a first box having walls that define a first interior compartment in a closed position. The walls include a top wall that is formed of a transparent material to permit viewing of the first interior compartment. The display also includes an inner box that is open along a top thereof and is disposed within the first interior compartment. The inner box partitions the interior compartment into a first section and a second section where the inner box is disposed. A boundary between the first and second sections is defined by vertical side wall of the inner box. The inner box is dimensioned so that when the first box is in the closed position, the inner box is adjacent one side wall and two end walls of the first box and is fully contained within the first box. The inner box has a second interior compartment.

The retail display includes a first article of clothing disposed within the first section, wherein the degree of movement of the first article of clothing is limited by walls of the first box and the vertical side wall of the inner box. A second article of clothing is disposed within the second interior compartment of the inner box. An aperture is formed in the top wall of the first box and positioned so that it extends across the vertical side wall of the inner box and allows access to both the first and second interior compartments to permit contact with both the first and second articles of clothing. The first article of clothing can be selected from the group consisting of a shirt and a sweater and the second article of clothing can be selected from the group consisting of a scarf, undershirt, gloves, and a hat.

These and other aspects, features and advantages shall be apparent from the accompanying Drawings and description of certain embodiments of the invention.

BRIEF DESCRIPTION OF THE DRAWINGS

FIG. 23 is a front elevation view of a box including an arrangement of clothing articles according to a tenth embodiment of the invention;

FIG. 24 is a front perspective view of the box of FIG. 23;

DETAILED DESCRIPTION OF CERTAIN EMBODIMENTS OF THE INVENTION

Figure 1:
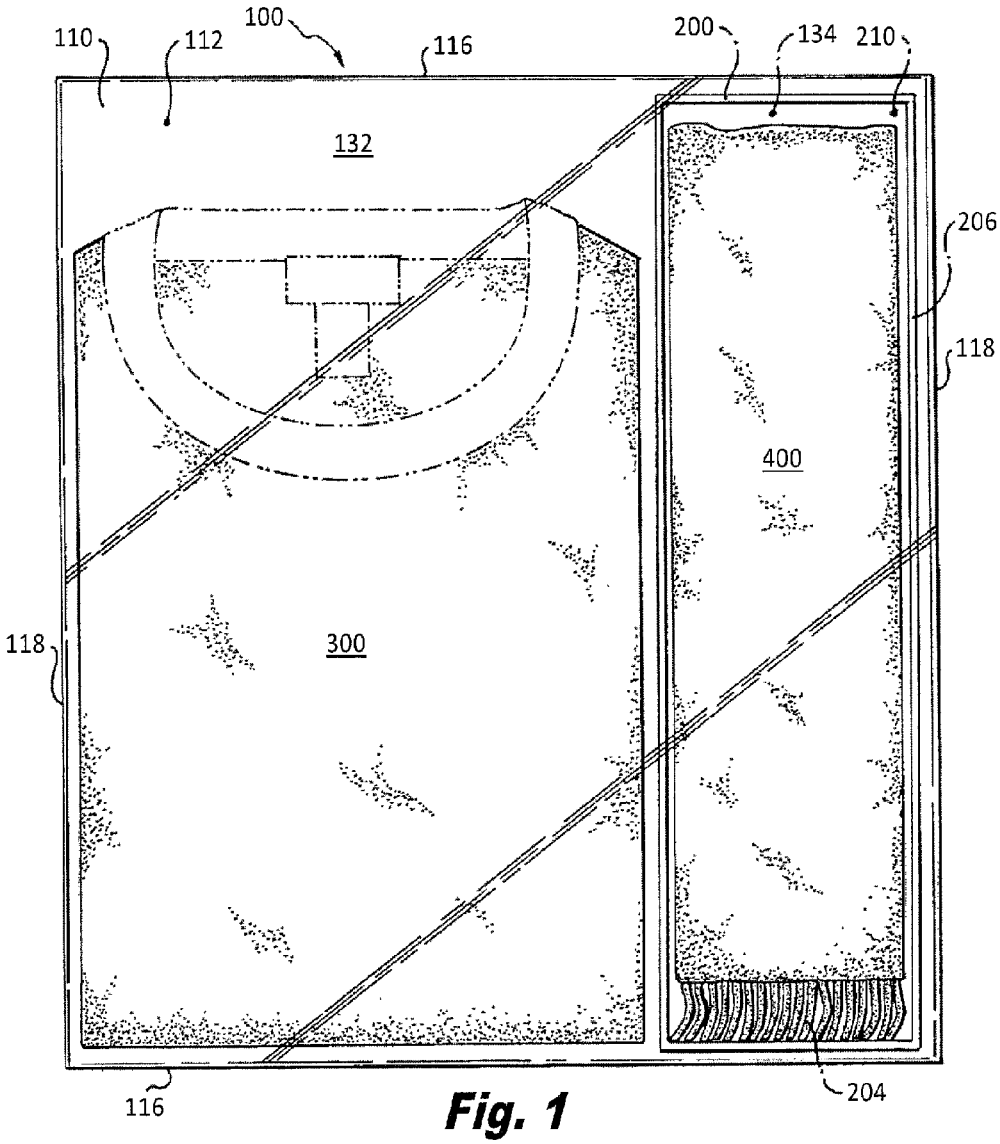
FIG. 1 is a front elevation view of a box including an arrangement of clothing articles according to a first embodiment of the invention.
Figure 2:
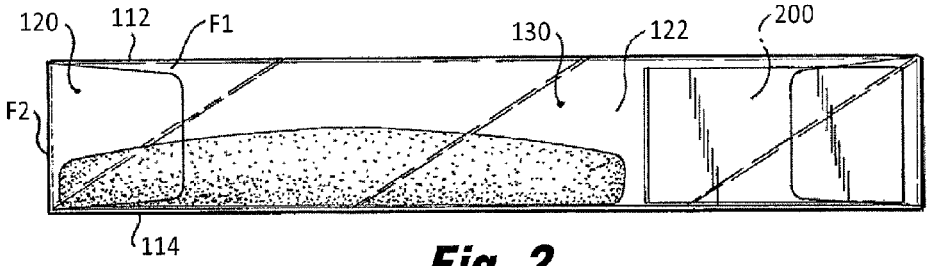
FIG. 2 is an end view of the embodiment of FIG. 1.
Figure 3:
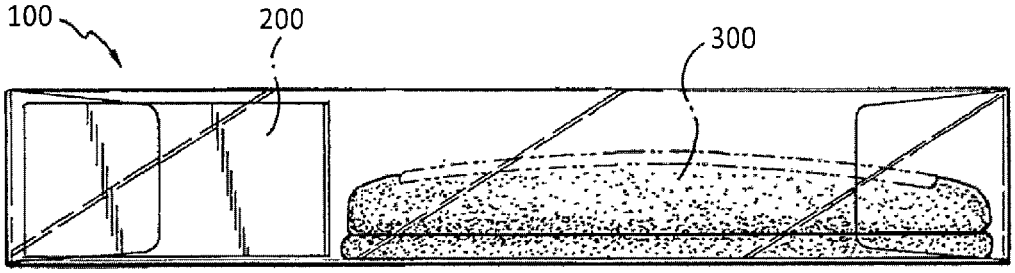
FIG. 3 is an opposite end view of the embodiment of FIG. 1.

Referring to FIGS. 1-3, a shirt box container 100 is made from a substrate 110 in the form of a transparent plastic sheet having a series of fold lines generally designated F1 and F2. The fold lines F1 are generally parallel and preferably are parallel to one another and can be characterized as being vertical fold lines that run from one end of the container to the opposite other end. The fold lines F2 are also generally parallel and preferably are parallel to one another and can be characterized as being horizontal fold lines. The fold lines F1, F2 define boundaries of respective panels of the substrate 110.

More specifically, the substrate 110 is divided into a number of different panels that define particular segments or regions of the substrate 110. In the basic form, the box 100 includes a top panel 112, a bottom panel 114, opposing end panels 116 and opposing side panels 118. In the illustrated embodiment, each of the panels has a generally rectangular. Each side panel 118 has a pair of flaps 120 and the top panel 112 and bottom panel 114 also include a pair of end panels 122. An exemplary box 100 is described in commonly assigned U.S. patent application Ser. Nos. 11/470,930 and 11/222,040, each of which is hereby incorporated by reference in its entirety.

While box 100, as shown, can be formed completely of a transparent material, other box design constructions are equally possible. For example, the box 100 can be formed only partially of a transparent material (in which case, at least the top panel 112 is formed of a transparent material to permit viewing of the product). The other portions of the box 100 can be formed of cardboard material or the like.

When the panels and flaps of the box 100 are folded and a fastening panel is fastened to another panel, an interior compartment 130 is defined for receiving and displaying an object. The bottom panel 114 thus defines a floor on which the object rests and the top panel 112 defines a ceiling. The height of the interior compartment 130 is generally defined by the width of the side panel 118.

As shown in FIGS. 1-3, in the first embodiment, an inner box (second box) 200 is disposed within the interior compartment 130. The inner box 200 effectively partitions the interior compartment 130 into a first section 132 and a second section 134. In the illustrated embodiment, the first section 132 occupies a greater area than the second section 134. However, the dimensions of the sections 132, 134 can be varied. Unlike the box 100, the inner box 200 is preferably not formed of a transparent material, such as a transparent plastic, but instead, is formed of cardboard material (paper) or the like. The inner box 200 is an open box in that it is open along its top to allow an object to be received and held therein. The inner box 200 has a base 202, a pair of end walls 204 and a pair of side walls 206 that extend between the end walls 204. The end and side walls 204, 206 extend upwardly from the base 202 so as to define an interior compartment 210. The dimensions of the inner box 200 are selected in view of the dimensions of the box 100 such that the inner box 200 can be received into the box 100. A length of the box 200, as measured as a length of the side wall 206, is less than a length of the side panel 118 to allow for the box 200 to be disposed and held within the closed box 100. In addition, a height of the inner box 200 is also slightly less than a height of the box 100 to allow for the box 200 to be received and held within the box 100.

In accordance with the present invention, a first clothing article 300 is received within the first section 132 of the interior compartment 130 and a second clothing article 400 is received within the second section 134 of the interior compartment 130 and more particularly, the second clothing article 400 is received within the interior compartment 210. In this manner and as illustrated, both articles of clothing 300, 400 are visible to the consumer in the box 100.

It will be appreciated that the inner box 200 is properly sized to allow for the first article of clothing 300 to be folded and displayed in a desired manner and similarly, the second article of clothing 400 can be also properly displayed. In the case of where the first article of clothing 300 is a shirt or sweater, or the like, the first section 132 is sufficiently large enough to allow for the shirt or sweater 300 to be folded in half as shown without interference from the adjacent side wall of the inner box 200. The width of the inner box 200 is such that there should be little space between the shirt 300 and the side wall of the inner box 200, thereby eliminating the ability of the shirt 300 to shift within the first section 132. The vertical side wall of the inner box 200 thus serves as a divider between the two articles of clothing 300, 400.

Figure 4:
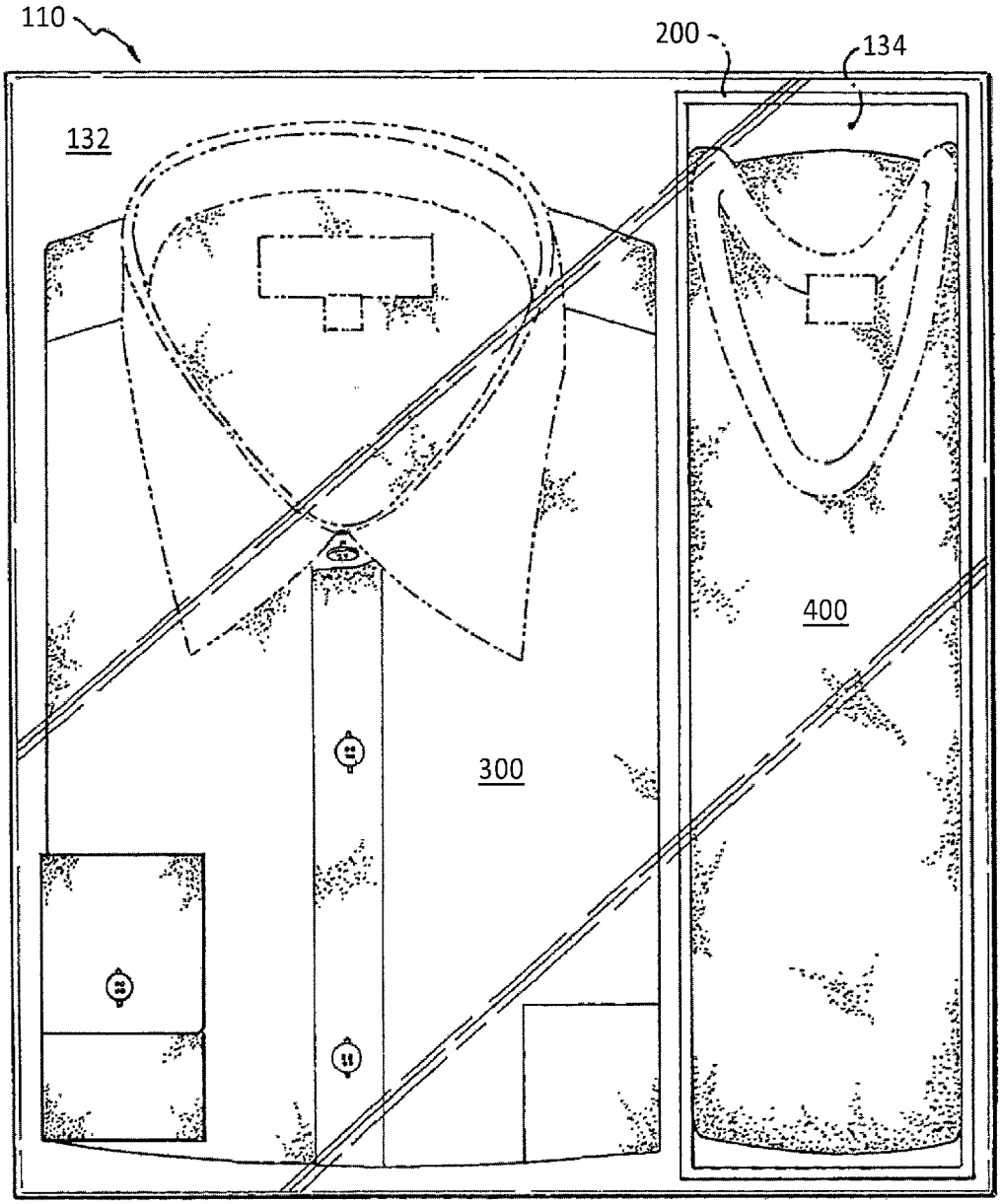
FIG. 4 is a front elevation view of a box including an arrangement of clothing articles according to a second embodiment of the invention.
Figure 5:
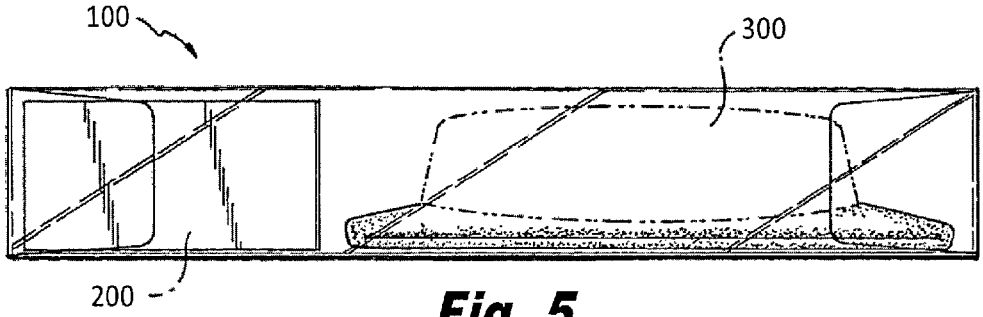
FIG. 5 is an end view of the embodiment of FIG. 4.
Figure 6:
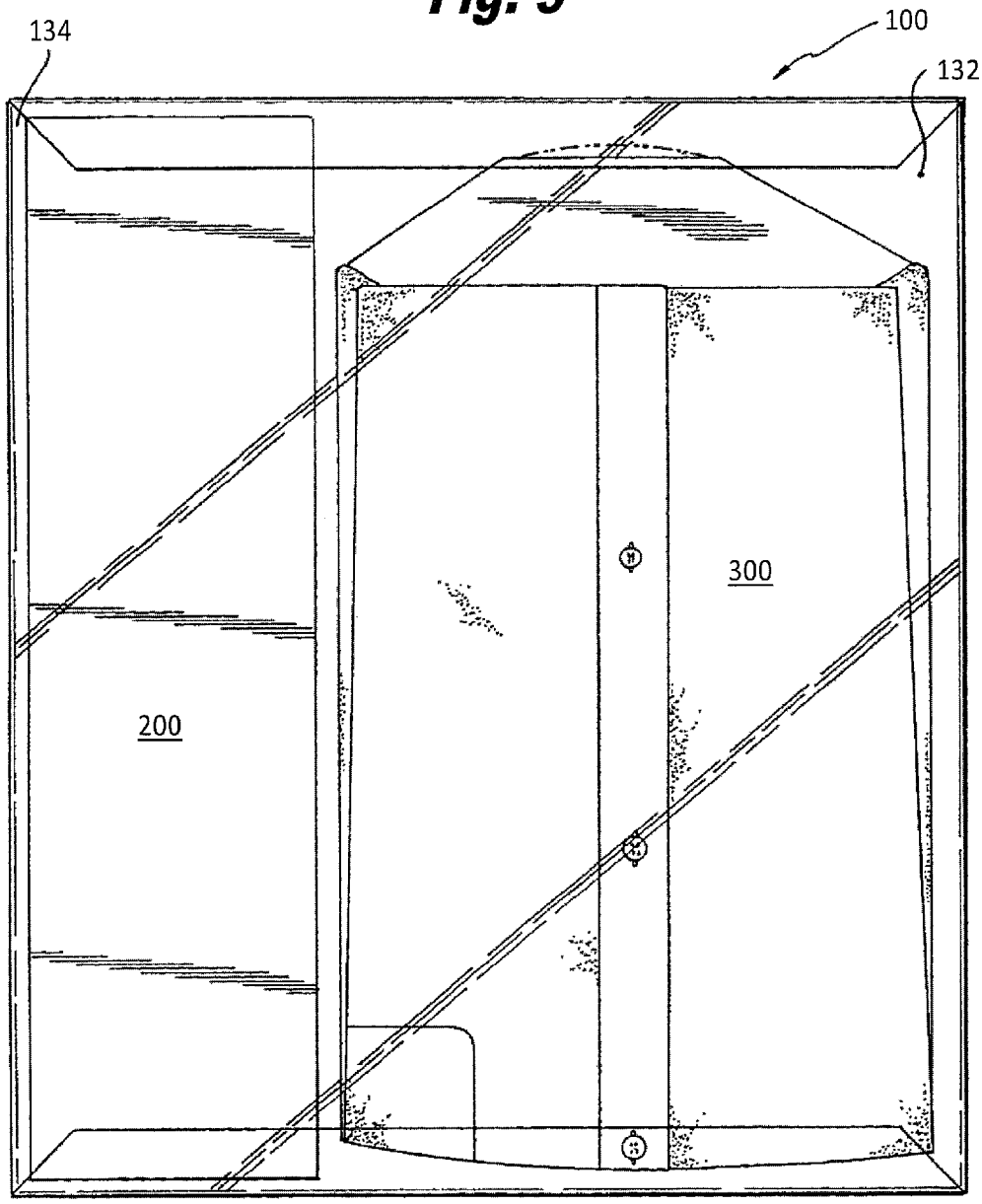
FIG. 6 is a rear elevation view of the embodiment of FIG. 4.

The articles of clothing 300, 400 can be any number of different types of clothing that complement one another. For example, in FIGS. 1-3, the first article of clothing 300 is in the form of a shirt or sweater and the second article of clothing 400 is in the form of a scarf. In FIGS. 4-6, the first article of clothing 300 is in the form of a shirt and the second article of clothing 400 is in the form of an undershirt meant to be worn with the shirt 300. Other combinations are equally possible. For example, the first article of clothing 300 can be a sweater, overshirt, jacket, etc., and the second article of clothing 400 can be a hat or gloves. In addition, the first article of clothing 300 can be in the form of peejays or sleepwear and the second article of clothing 400 can be in the form of a complementary article of clothing. It will therefore be appreciated that any number of combinations of articles of clothing can be used. FIGS. 1 and 2 show the first article of clothing 300 being a sweater and the second article of clothing 400 being a scarf. FIGS. 3 and 4 show the first article of clothing 300 being a shirt and the second article of clothing 400 being an undershirt.

There is preferably a level of coordination between the articles of clothing 300, 400 since the two articles are packaged together for retail sale. This coordination eliminates the guess work by an uneducated consumer who is not savvy in selecting a tie to match with a shirt or the matching of a scarf to go with a sweater. By carefully coordinating the two articles of clothing 300, 400, the consumer can simply purchase a single retail package, namely box 100, in a simple process and have a carefully, well coordinated outfit.

The coordination between the articles of clothing 300, 400 also preferably extends to the size of the articles 300, 400. For example, the size of the undershirt 400 is selected in view of the size of the shirt 300 and the size of the scarf 400 is selected in view of the size of the first article 300.

However, by locating and retaining the second article of clothing within the inner box 200, the two articles of clothing 300, 400 are always separated from one another and are maintained in a neat fashion since the sizes of the sections 132, 134 permit the two articles 300, 400 to be properly displayed in a visually appealing manner. In addition, the use of the inner box 200 permits its easy removal by simply sliding the inner box 200 out of the box 100 and then replacing it with a new box or replacing the garment 400 within the inner box 200.

Figure 7:
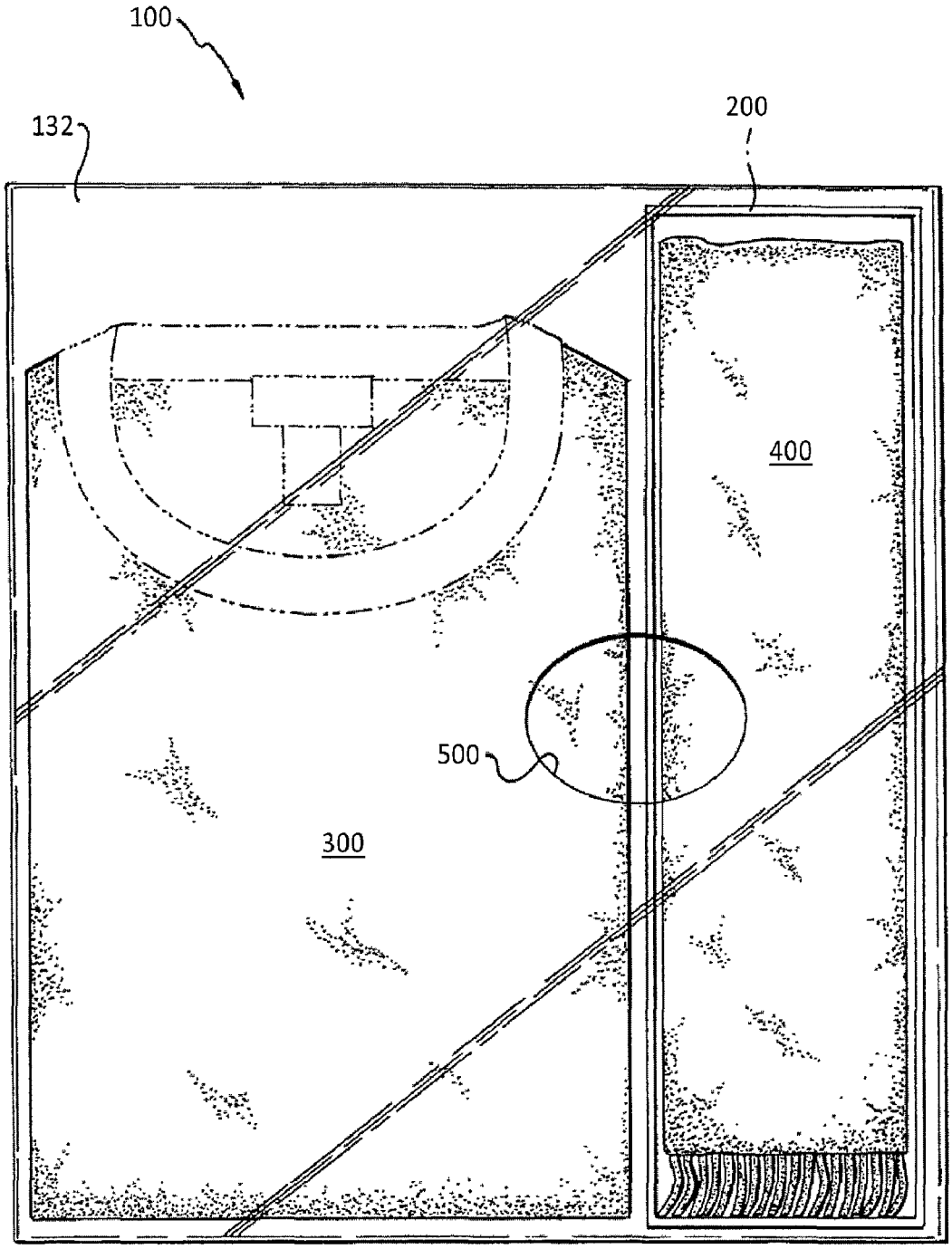
FIG. 7 is a front elevation view of a box including an arrangement of clothing articles according to a third embodiment of the invention.
Figure 8:
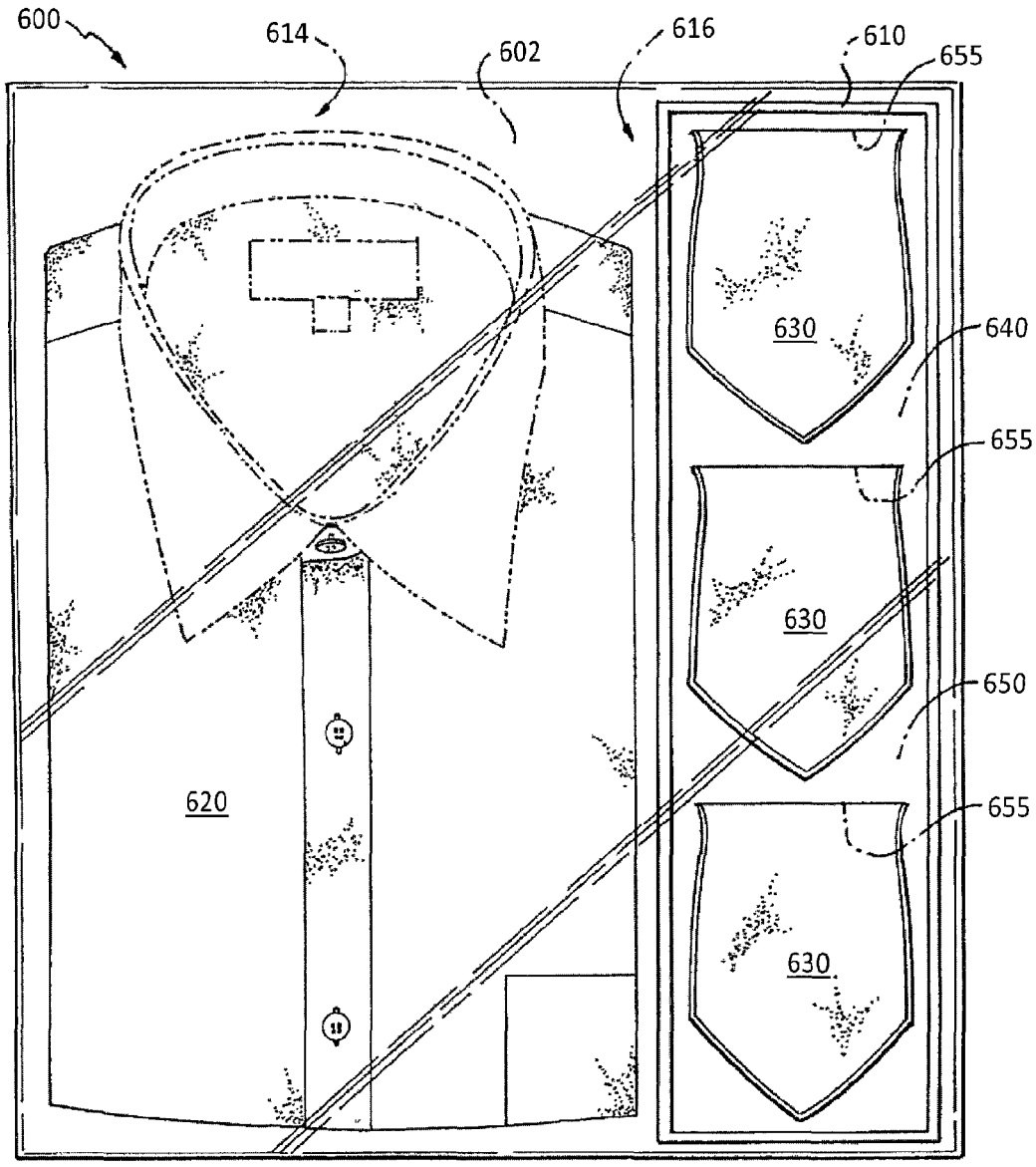
FIG. 8 is a front elevation view of a box including an arrangement of clothing articles according to a fourth embodiment of the invention.
Figure 9:
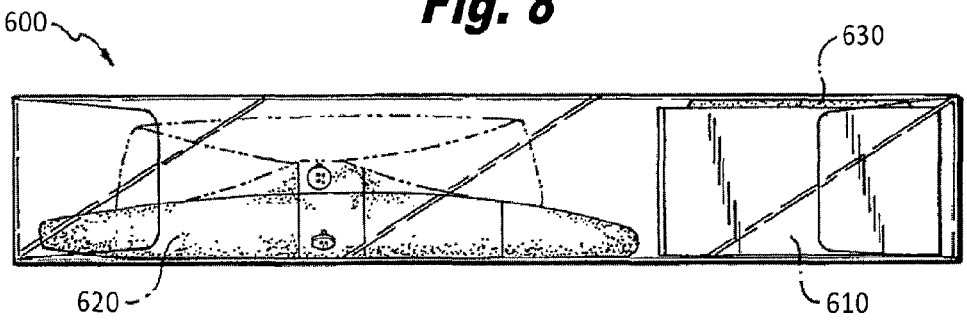
FIG. 9 is an end view of the embodiment of FIG. 8.
Figure 10:
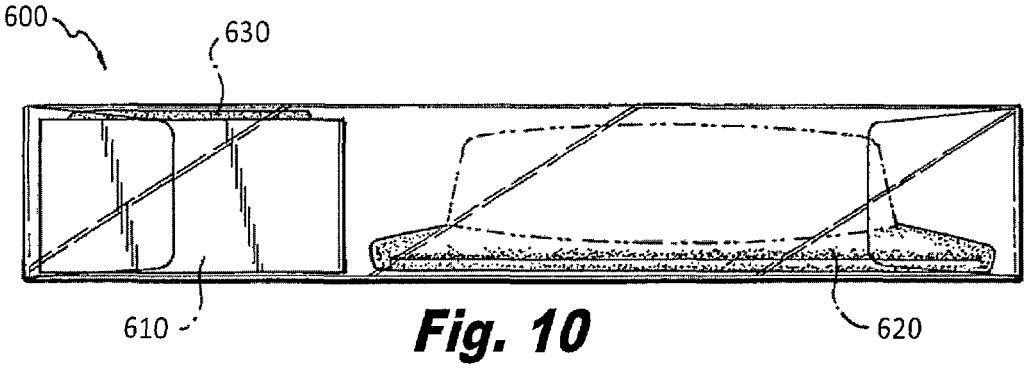
FIG. 10 is another end view of the embodiment of FIG. 8.
Figure 11:
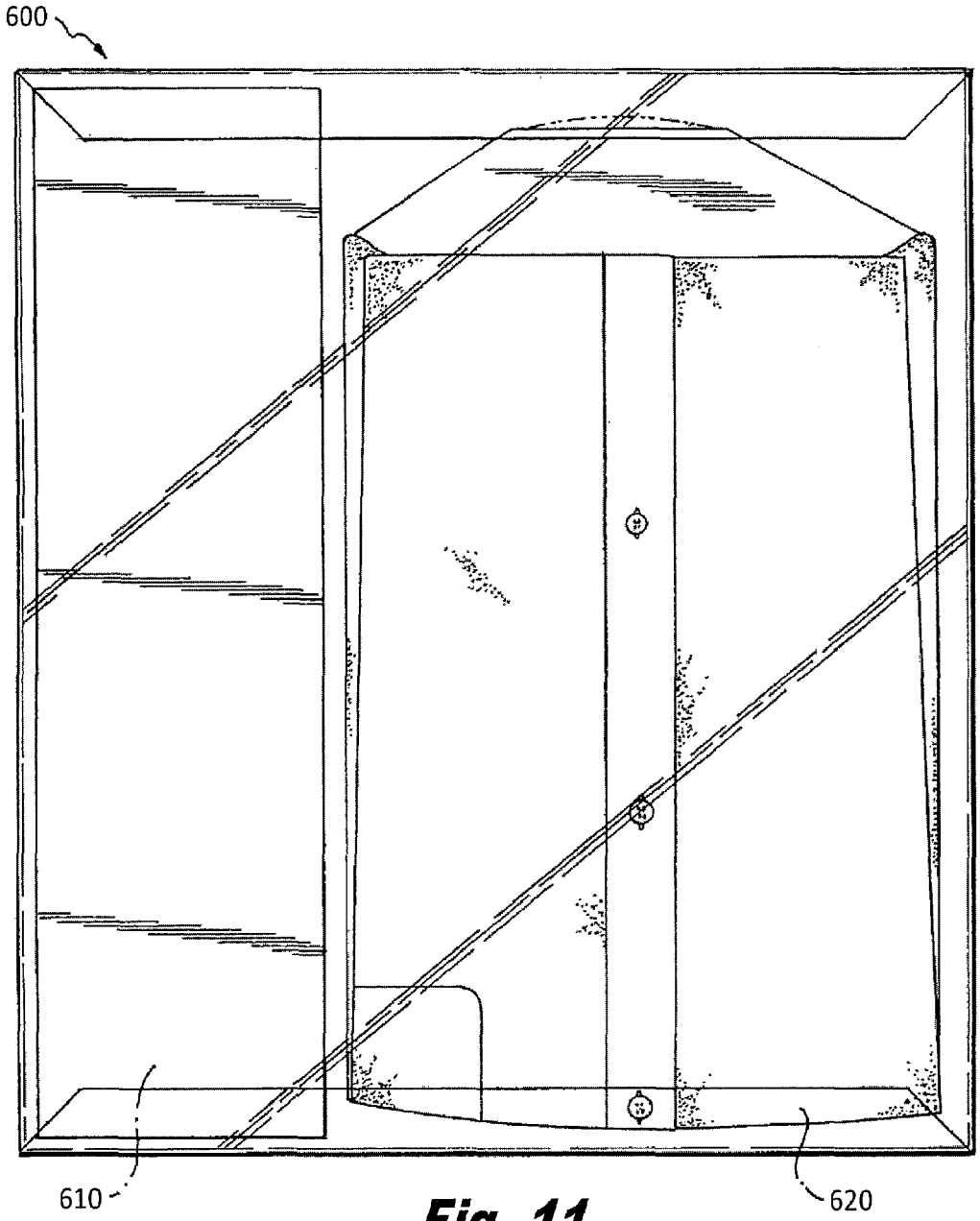
FIG. 11 is a rear elevation view of the embodiment of FIG. 8.

As shown in FIG. 7, the shirt box 100 can be formed with hole 500 in one of the panels that forms the box 100. More specifically, the hole 500 is strategically formed in the top panel 112 of the box 100 such that the hole 500 overlies the both the first section 132 and the second section 134. In other words, the hole 500 is positioned such that it extends across the side wall of the inner box 200 that is adjacent the first article of clothing 300 and overlies a portion of the interior compartment 210 and overlies a portion of the first section 132. This positioning of the hole 500 provides access to both the article 300 that is disposed within the first section 132 and the article 400 that is disposed within the inner box 200. A consumer can thus touch and feel both articles 300, 400 yet this feature does not compromise the structural integrity of the box 100. It will be appreciated that the shape and size of the hole 500 are not critical and the hole 500 is therefore not limited to having an oval shape. The hole 500 can thus have other shapes, including but not limited to, square, triangular, rectangular, circular, irregular, etc.

It will also be appreciated that the inner box 200 can include a transverse wall that effectively partitions the inner box 200 into two sections that can separately store two different items (clothing articles). For example, the inner box 200 can be divided into a first compartment for holding the article 400 and a second compartment for holding a complementary additional article. In the case of the first compartment holding the scarf 400, the second compartment can hold a complementary hat or complementary gloves. In the case of undershirts, the two compartments can hold two different undershirts. When the inner box 400 is divided into two compartments, the hole 500 can be positioned so that not only does it extend across the innermost side wall of the inner box 200 to allow the consumer to touch the first article 300 but it is also positioned so that it extends across the transverse wall that partitions the inner box 400 into the two compartments. In other words, the hole 500 is positioned so that it at least partially overlies all three articles of clothing to allow the consumer to touch and feel each article of clothing that is being packaged and presented to the consumer. Alternatively, instead of having a single inner box, two inner boxes can be provided and placed in a stacked relationship along one side wall of the box 100. In this embodiment, the hole 500 is positioned over the first section and also it lies over a portion of each of the two, inner side boxes.

In addition, the first article 300 can be in the form of a shirt and the second article 400 can be in the form of one or more ties 400 that are stored in the inner box 200.

In yet another embodiment, the inner box 200 is formed of a clear transparent material to permit viewing of the contents (e.g., article 400) of the inner box 200 through both the side walls and end walls and bottom wall of the inner box 200.

FIGS. 8-11 illustrate a box 600 that can be similar to box 100 in that it is formed of a plastic sheet of transparent material; however, the box 600 does not have to be completely transparent since the ends and/or side panels can be opaque in nature. In most instances, the front and rear panels of the box 600 are transparent to allow a consumer to view the articles 300, 400.

Box 600 includes an inner box 610 that is disposed within an interior 602 of the box 600. Similar to the box 100, the inner box 610 effectively partitions the interior 602 into a first region 614 and a second region 616. The first region 614 contains a first article of clothing 620 which can be any of the articles of clothing listed herein and others. In the illustrated embodiment, the first article of clothing 620 is in the form of a shirt (e.g., dress shirt). The inner box 610 includes a number of second articles of clothing 630 which in the illustrated embodiment is in the form of three ties. The ties 630 are separately displayed within the inner box 610 next to the shirt 620.

The inner box 610 has a base portion 640 that is generally a hollow box having one open side (e.g., front side) and therefore, includes a floor, a pair of upstanding side walls and a pair of upstanding end walls that define an interior chamber or compartment that holds items, such as the three ties 630. The inner box 610 also includes a top cover 650. The top cover 650 is formed of a top wall 652 and a pair of opposing side walls that extend along the peripheral side edges of the top wall 652. The top cover 650 is designed to be received within the interior compartment of the inner box 610 such that the side walls of the top cover 650 seat against inner surfaces of the side walls of the inner box 610. The height of the side walls of the top cover 650 is selected to place the top wall of the top cover 650 proximate upper edges of the side and end walls of the base portion 640 so as to provide a relatively planar top surface. The top cover 650 has a plurality of transverse slits 655 formed therein and in the illustrated embodiment, there are three slits 655 to accommodate the three ties 630. Each slit 655 has a width that is great enough to receive the greatest width portion of the tie 630. Each tie 630 is positioned so that a portion including a first end thereof is contained within the interior compartment of the base portion 640 and another portion extends through the slit 655 and across the top cover 650. For example, an opposite end (wide end) of the tie 630 is laid across the top cover 650 so that it is visible to the consumer. The end of the tie 630 does not extend as far as the next slit 655 and therefore, does not interfere with the display of the next tie 630. In this manner, each tie 630 is fed through one slit 655 and is overlaid over the top cover 650 for display to a consumer. The end of the tie 630 can simply rest on the top cover 650.

The ties 630 can be the same or they can be different in that they can include different patterns, different colors, or a combination thereof.

The three ties 630 can be individually rolled and stored within the interior of the base portion 640. In other words, the portion of the tie 630 that lies below the top cover 650 can be rolled (e.g., spiral shaped roll). In this embodiment, the three ties 630 are separate from one another both below the top cover 650 within the interior of the base portion 640 and above the top cover 650. However, the portions of the ties 630 that are below the top cover 650 within the interior of the base portion 640 can be commingled with one another as described below with reference to FIGS. 19-22.

As with other embodiments, the inner box 610 can be formed of an opaque material (e.g., cardboard) or the inner box 610 can be formed of a transparent material. The box 600 can be formed completely of a transparent material or the box 600 can be partially transparent and partially opaque. For example, at least the front and rear panels of the box 600 can be formed of a transparent material to allow the articles of clothing to be visible.

It will be appreciated that the top cover 650 can include a V-shaped slit formed therein as described in commonly assigned U.S. patent application Ser. No. 60/952,934, filed Jul. 31, 2007, which is hereby incorporated by reference in its entirety. Each tie 630 has its own associated V-shaped slit.

Figure 12:
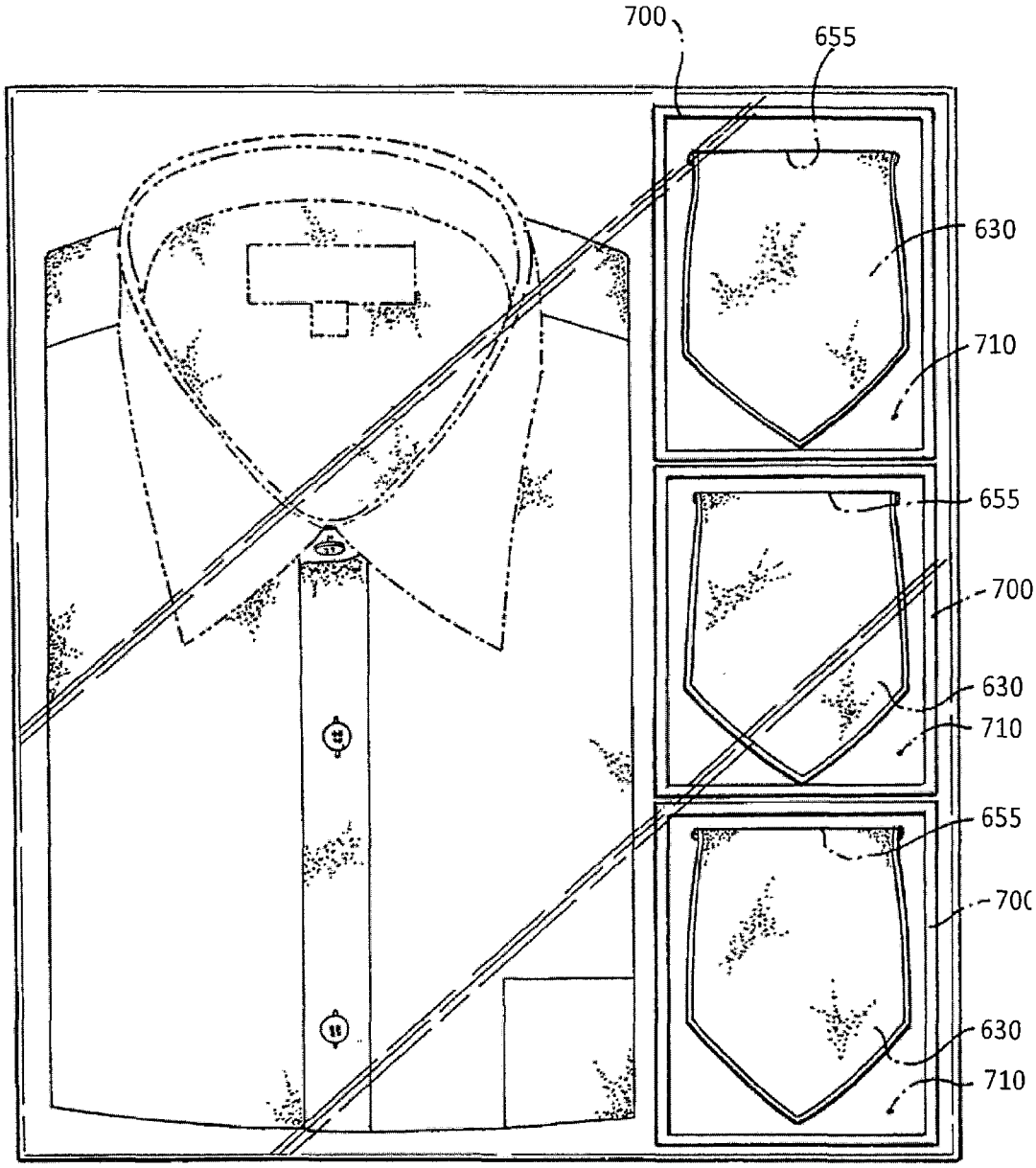
FIG. 12 is a front elevation view of a box including an arrangement of clothing articles according to a fifth embodiment of the invention.

FIG. 12 illustrates another embodiment in which the three ties 630 are stored in three separate boxes 700 that are stacked on top of one another along one side of the box. In this embodiment, each tie 630 is separately stored in one box 700 and in particular, the tie 630 is rolled or folded underneath the top cover 710 and is then fed through the one slit 655. The slit 655 can be formed between one end of the top cover 710 and one end wall of the inner box 610 or the slit 655 can be formed in the top cover 710. Once again, the slit 655 is of sufficient size to allow the tie 630 to be fed therethrough.

Figure 13:
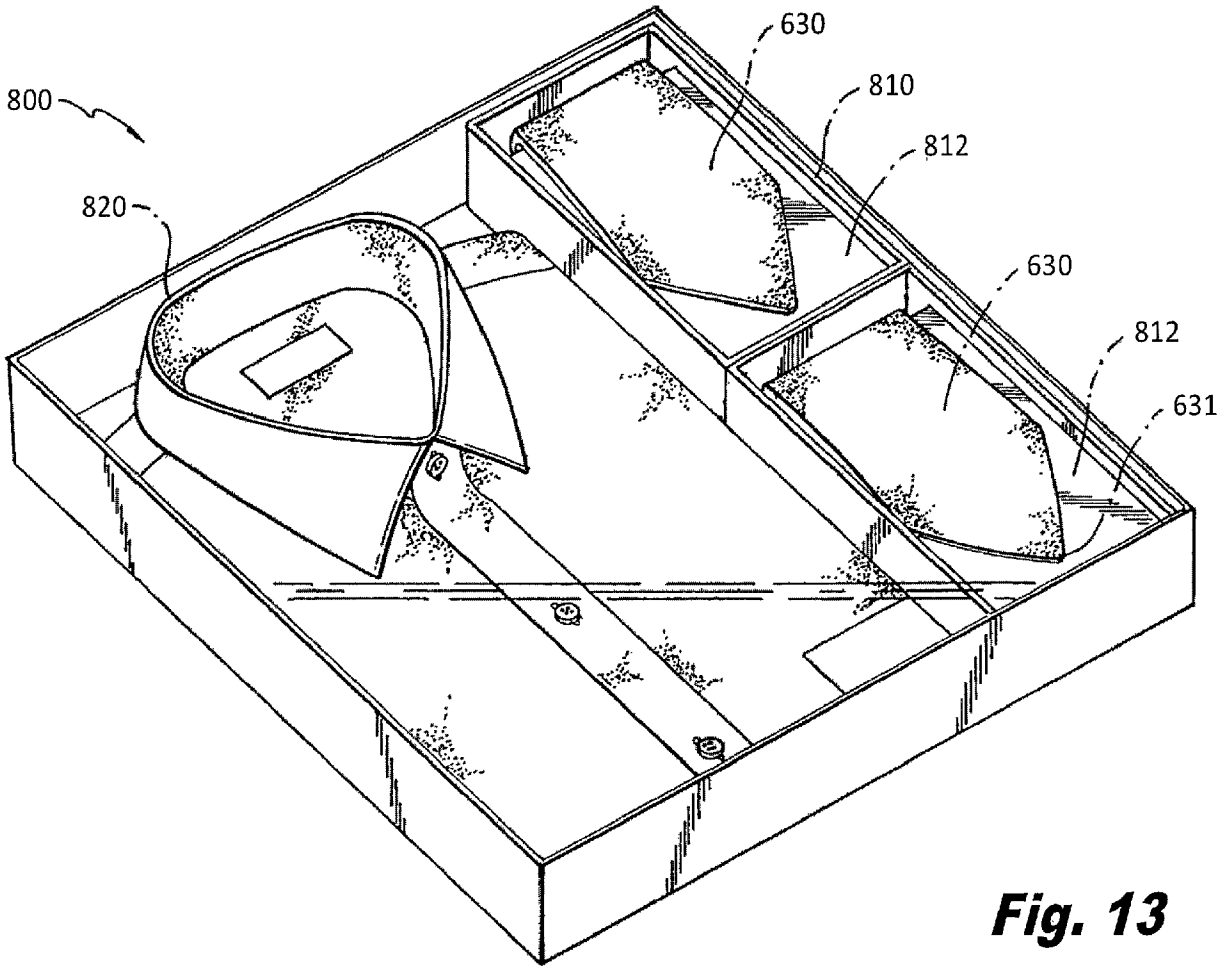
FIG. 13 is a front, end and side perspective view of a box including an arrangement of clothing articles according to a sixth embodiment of the invention.

FIG. 13 shows a box 800 that can be similar or the same as the box 100 and includes a pair of stacked inner boxes 810 that partition the interior compartment 802 of the box 800 into two regions. One region is a region that receives a first article of clothing 820 (e.g., a formal, dress or casual shirt) that is disposed adjacent the stacked inner boxes 810. The inner boxes 810 can hold any number of articles that are complementary to the first article of clothing 820. For example, as illustrated, each inner box 810 includes one tie 630. One again, a top cover 812 of the inner box 810 can include a V-slit as described above and therefore, the pointed end of the tie 630 does not necessarily have to be positioned along the top cover 812 but instead can actually be located below the top cover 812 or the top cover 812 can be a flat surface on which the pointed end 631 of the tie 630 rests. It will also be appreciated that while the stacked boxes 810 are shown along the right side of the box 800, the boxes 810 can be stacked along the opposite left side of the box 800. In the illustrated embodiment, the inner boxes 810 include two ties; however, the inner boxes 810 can include other items, such as jewelry or other articles of clothing.

Figure 14:
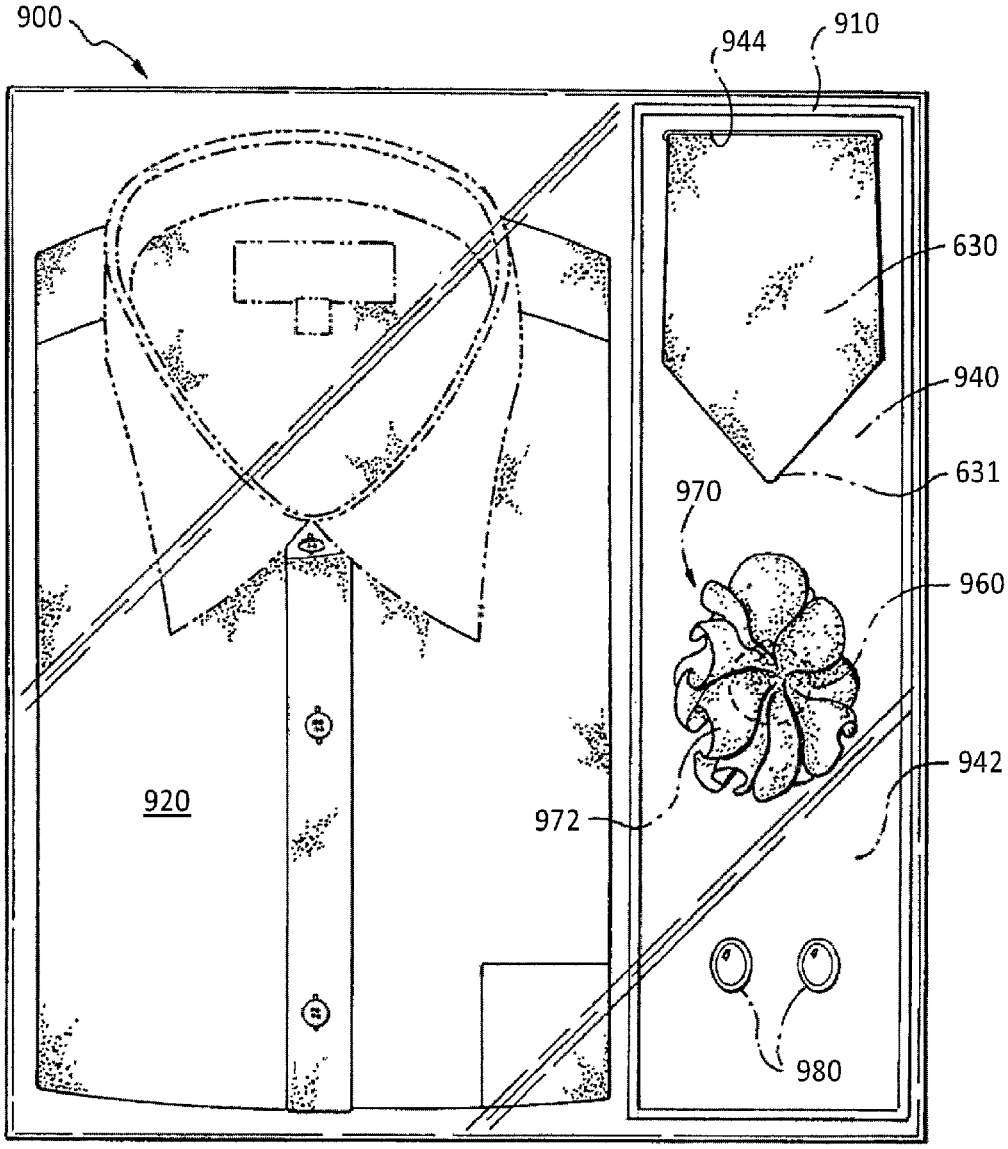
FIG. 14 is a front elevation view of a box including an arrangement of clothing articles according to a seventh embodiment of the invention.
Figure 15:
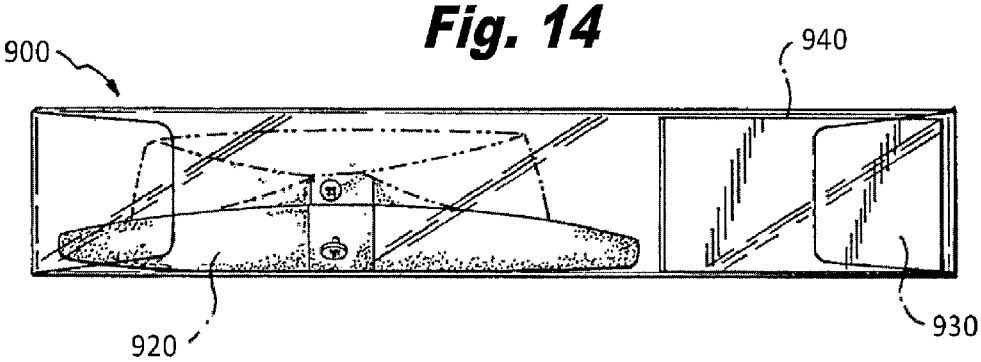
FIG. 15 is an end elevation view of the embodiment of FIG. 14.

FIGS. 14 and 15 show another box 900 that includes an inner box 910. As with the other embodiment, the inner box 910 is received within an interior compartment of the box 900 and serves to partition the interior compartment into two sections, one of which receives a first article of clothing 920. All panels (walls) of the box 900 can be formed of a transparent material or select panels thereof can be transparent. At least the front panel and typically also the rear panel are transparent to allow a consumer to view the contents of the box. However, the sides and ends of the box 900 can be opaque. The inner box 910 can be formed of a transparent material to allow the contents to be seen or the inner box 910 can be formed of an opaque material, as in the case of when the inner box 910 is made of a cardboard material.

Once again, any number of different articles of clothing can be used as the first article of clothing 920. For example, the article of clothing 920 can be in the form of a shirt (formal, dress or casual) as shown. The shirt 920 is folded and received within the box 900 adjacent the inner box 910. The inner box 910 has a base portion 930 that is open along one portion (e.g., front portion) to allow items to be received within an interior compartment of the box 910. The base portion 930 has a floor and opposing end walls and opposing side walls that extend upwardly therefrom to close off and define the interior compartment.

A top cover 940 is received within the base portion 930 to effectively close off the base portion 930. The top cover 940 has a center wall 942 and two side walls or flaps that extend therefrom along a longitudinal length of the top cover 940. The center wall 942 defines the ceiling of the inner box 910 when the top cover 940 is received within the base portion 930 and the side walls of the cover 940 are disposed within the interior compartment of the inner box 910 between the side walls thereof. When the top cover 940 is inserted into the interior compartment of the inner box 910, the side walls act as legs that support to the top cover 940 and allow it to stand therein. An empty space is thus formed between the wall 942 (which acts as a ceiling of the inner box 910) and the floor of the base portion 930.

In accordance with one embodiment, the top cover 940 is designed to allow a number of different items to be displayed and stored within the inner box 910. For example, the wall 942 of the top cover 940 can include a slit 944 through which the tie 630 extends. As shown, the wide end 631 of the tie 630 is positioned along the outer surface of the wall 942 for display. The remaining portion of the tie 630 is not in view but instead is located below the top cover 940 within the interior compartment of the inner box 910. This portion of the tie that lies below the top cover 940 can be in a rolled condition or a folded condition.

The top cover 940 is also constructed to display other items. For example, an opening 960 can be formed through the top cover 940. The opening 960 can have any number of different shapes (e.g., circle, square, triangle, rectangle, oval, etc.) and sizes to permit an object to pass therethrough. More specifically, a handkerchief or pocket square 970 can pass therethrough for display adjacent the tie 630. The handkerchief or pocket square 970 is simply gathered together and fitted through the opening 960 so that a portion thereof is located below the top cover 940 and another portion 972 is located above the top cover 940 for display to the consumer.

In addition, the top cover 940 can include one or more slits (not shown) that allow jewelry 980 to be secured coupled to the top cover 940 for display to the consumer. For example and as shown, a pair of cuff links 980 can be attached to the top cover 940 for display by passing the stems of the links 980 through the slits and then engaging the clip portion of the links 980 to an underside of the top cover 940. This results in the jewelry 980 being displayed along with the other items.

Figure 16:
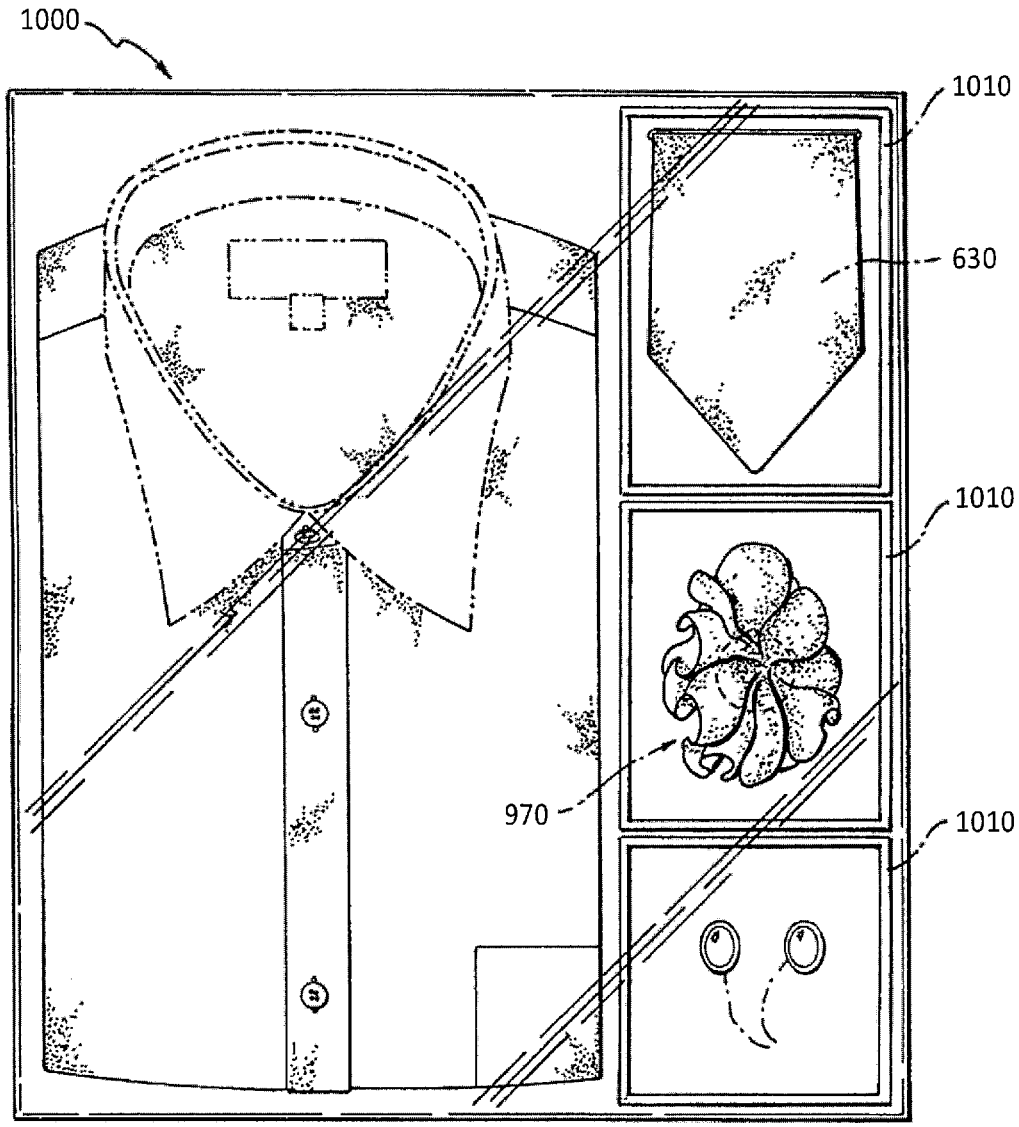
FIG. 16 is a front elevation view of a box including an arrangement of clothing articles according to an eighth embodiment of the invention.

FIG. 16 shows a box 1000 that is similar to the box 900 with the exception that instead of a single inner box 910, there are three individual inner boxes 1010. Each box 1010 holds one or more items. For example, one box 1010 holds the tie 630, one box 1010 holds the handkerchief or pocket square 970, and one box 1010 includes the cuff links 980.

Figure 17:
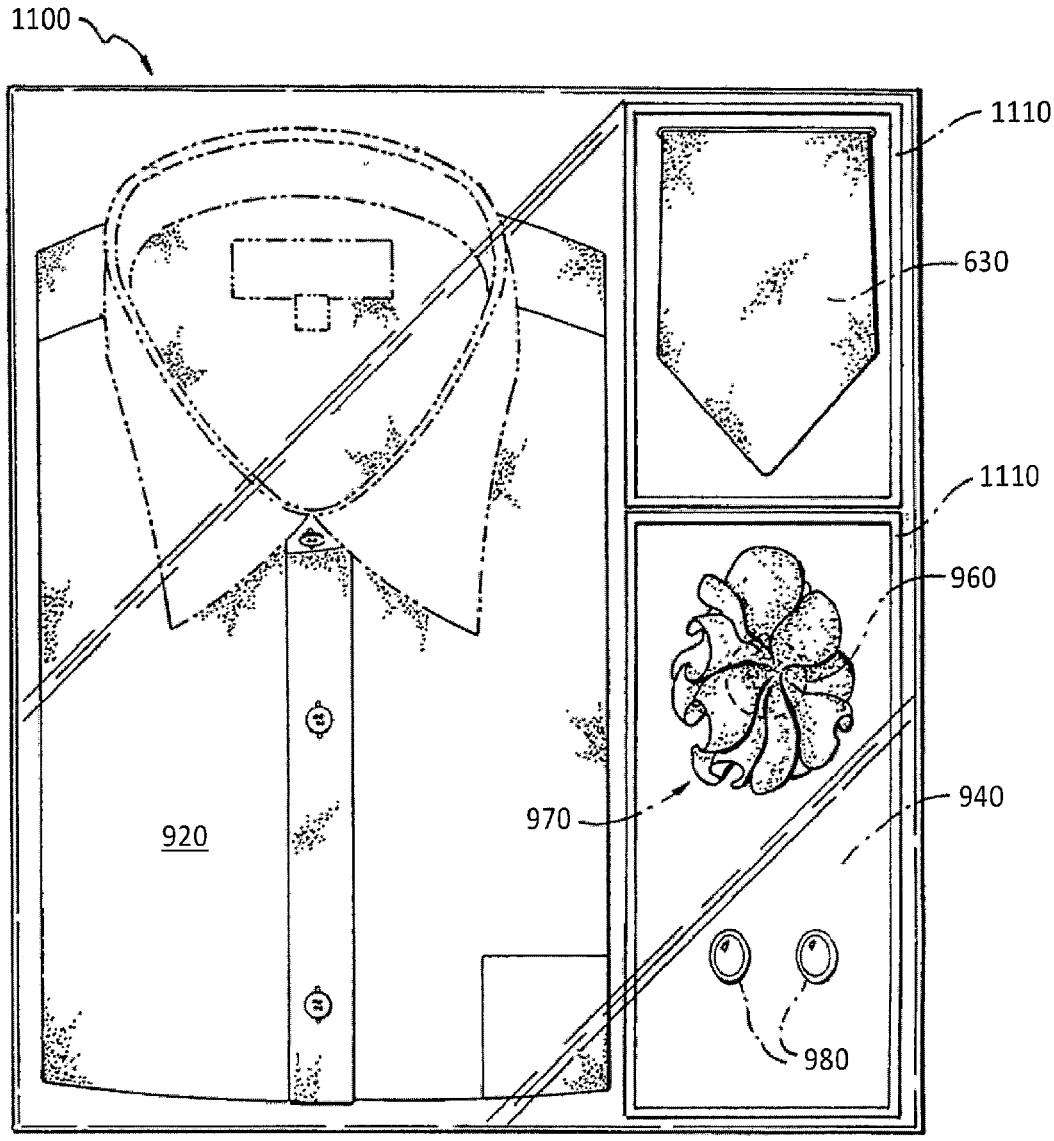
FIG. 17 is a front elevation view of a box including an arrangement of clothing articles according to an eighth embodiment of the invention.

FIG. 17 shows a box 1100 that is similar to the box 900 with the exception that instead of a single inner box 910, there are two individual inner boxes 1110. Each box 1010 holds one or more items. For example, one box 1010 holds the tie 630, one box 1010 holds the handkerchief or pocket square 970 and the cuff links 980.

Figure 18:
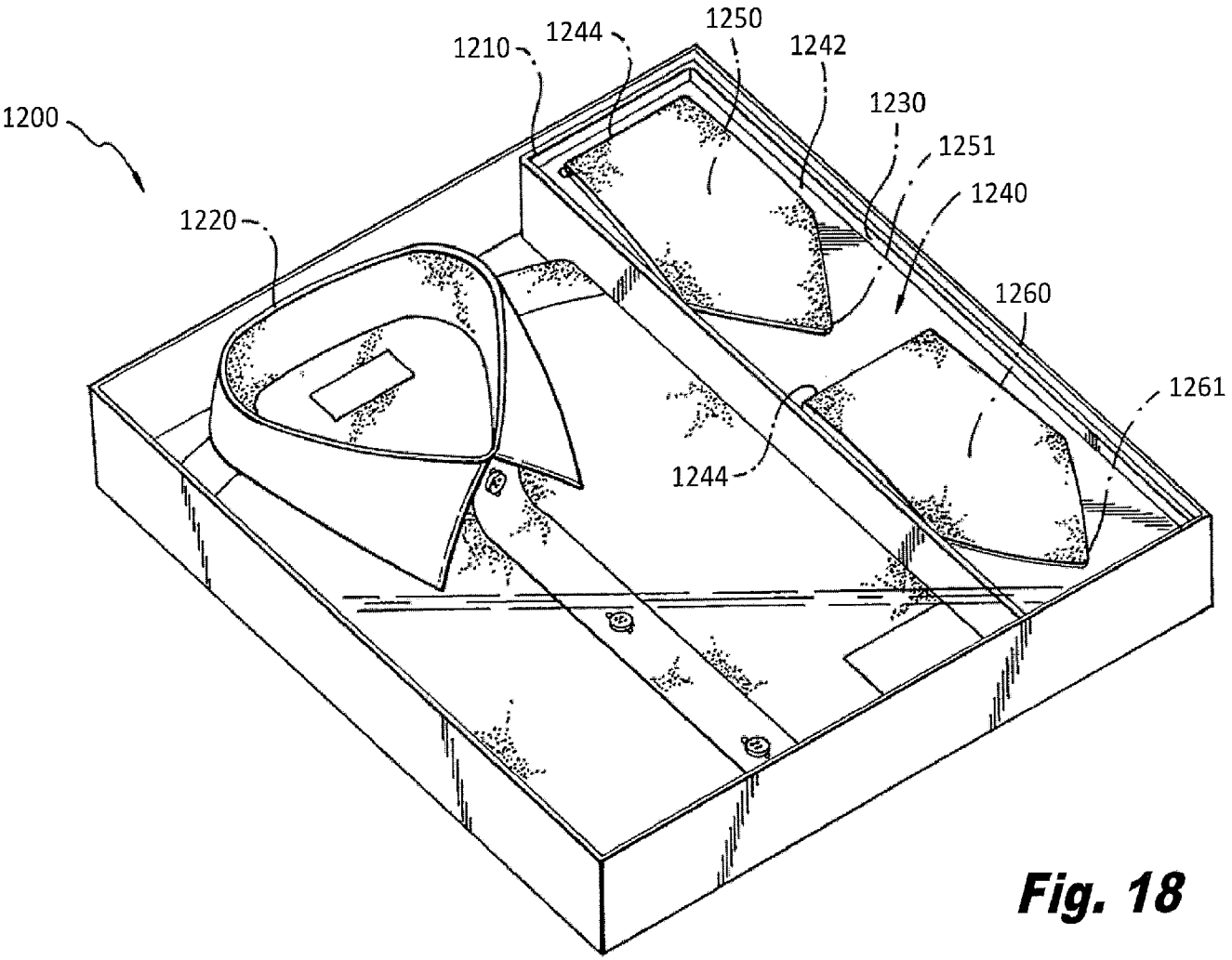
FIG. 18 is a front, side and end perspective view of a box including an arrangement of clothing articles according to a ninth embodiment of the invention.

FIG. 18 shows another box 1200 that includes an inner box 1210. As with the other embodiment, the inner box 1210 is received within an interior compartment of the box 1200 and serves to partition the interior compartment into two sections, one of which receives a first article of clothing 1220. All panels (walls) of the box 1200 can be formed of a transparent material or select panels thereof can be transparent. At least the front panel and typically also the rear panel are transparent to allow a consumer to view the contents of the box. However, the sides and ends of the box 1200 can be opaque. The inner box 1210 can be formed of a transparent material to allow the contents to be seen or the inner box 1210 can be formed of an opaque material, as in the case of when the inner box 1210 is made of a cardboard material.

Once again, any number of different articles of clothing can be used as the first article of clothing 1220. For example, the article of clothing 1220 can be in the form of a shirt (formal, dress or casual) as shown. The shirt 1220 is folded and received within the box 1200 adjacent the inner box 1210. The inner box 1210 has a base portion 1230 that is open along one portion (e.g., front portion) to allow items to be received within an interior compartment of the box 1210. The base portion 1230 has a floor and opposing end walls and opposing side walls that extend upwardly therefrom to close off and define the interior compartment.

A top cover 1240 is received within the base portion 1230 to effectively close off the base portion 1230. The top cover 1240 has a center wall 1242 and two side walls or flaps 1243 (FIG. 20) that extend therefrom along a longitudinal length of the top cover 1240. The center wall 1242 defines the ceiling of the inner box 1210 when the top cover 1240 is received within the base portion 1230 and the side walls of the cover 1240 are disposed within the interior compartment of the inner box 1210 between the side walls thereof. When the top cover 1240 is inserted into the interior compartment of the inner box 910, the side walls act as legs that support to the top cover 940 and allow it to stand therein. An empty space is thus formed between the wall 1242 (which acts as a ceiling of the inner box 1210) and the floor of the base portion 1230.

In accordance with one embodiment, the top cover 1240 is designed to allow a number of different items to be displayed and stored within the inner box 1210. For example, the wall 1242 of the top cover 1240 can include a pair of slits 1244 through which two ties 1250, 1260 extend. As shown, the wide end 1251, 1261 of each tie 1250, 1260 is positioned along the outer surface of the wall 1242 for display. The remaining portions of the ties 1250, 1260 are not in view but instead are located below the top cover 1240 within the interior compartment of the inner box 1210. This portion of the tie that lies below the top cover 1240 can be in a rolled condition or a folded condition as described in detail below.

Figure 19:
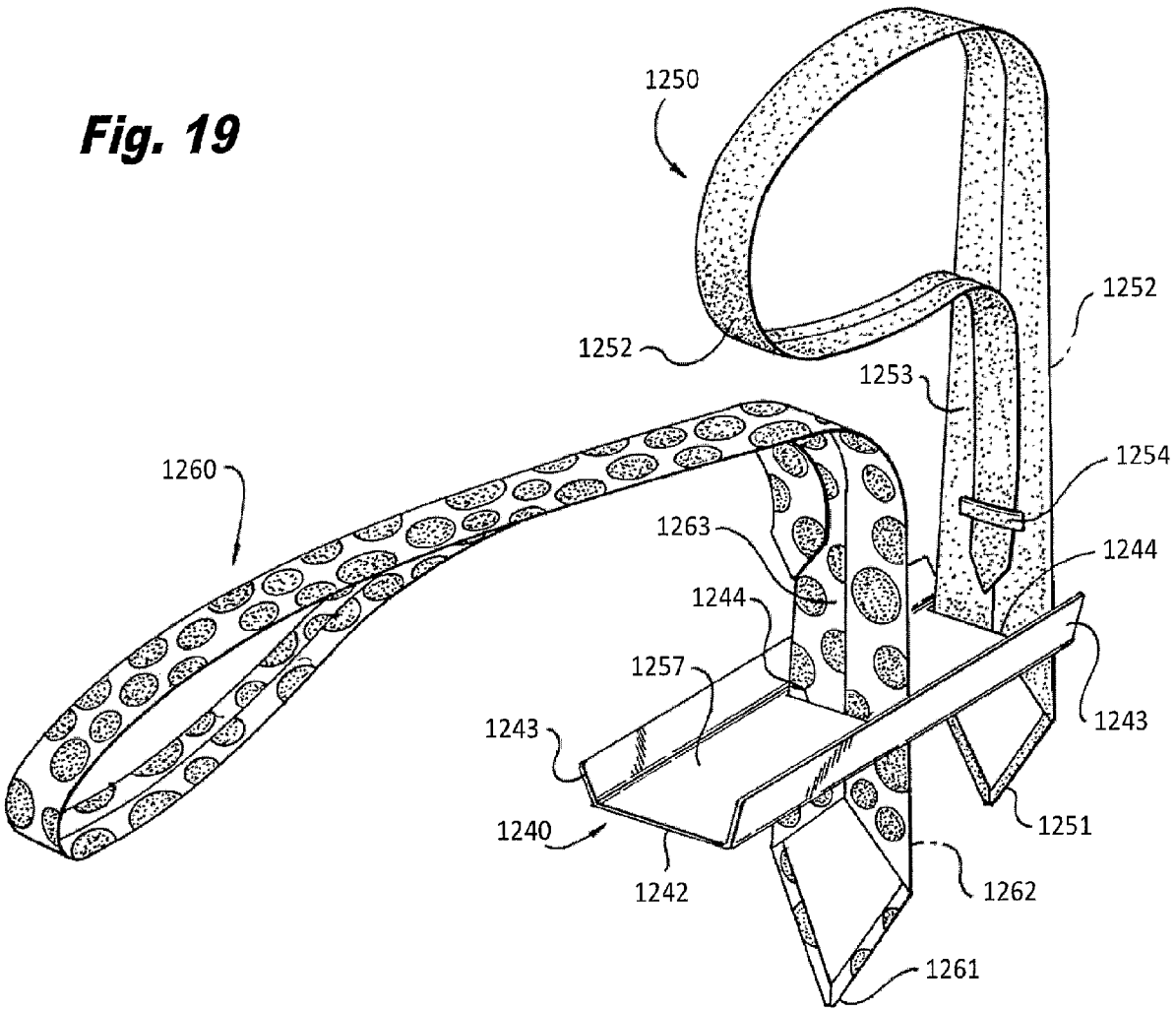
FIG. 19 is a rear elevation view of a top cover of an inner box of FIG. 18 with two ties being fed through slits formed therein.

FIGS. 19-22 show a method of arranging the two ties 1250, 1260 below the top cover 1240. In FIG. 19, an underside of the top cover 1240 is shown and in particular, an inner surface 1257 of the wall 1242 is shown and the flaps 1243 extend upwardly. The tie 1250 has a narrow end that is opposite the wide end 1251 and includes a front face 1252 and an opposite rear face 1253. The rear face 1253 includes a fabric loop 1254 that is used to receive and hold the narrow portion of the tie to the wider portion when it is folded. In the first step, the tie 1250 is folded over and the narrow end of the tie 1250 is inserted through the loop 1254. The fold is such that that the narrow end of the folded tie 1250 does not extend beyond the wide end 1251. The tie 1250 is then positioned so that the rear face 1253 faces upward and then the wide end 1251 is fed through the slit 1244 and along the outer surface of the top cover 1240 until the end 1251 is located proximate the other slit 1244 that receives tie 1260. As the tie 1250 is fed through the slit 1244, it is folded over and laid flush against the outer surface of the wall 1242 of the top cover 1240 with the front face 1252 facing away from the wall 1242.

Similarly, the tie 1260 has a narrow end that is opposite the wide end 1261 and includes a front face 1262 and an opposite rear face 1263. The rear face 1263 includes a fabric loop (not shown) that is used to receive and hold the narrow portion of the tie to the wider portion when it is folded. In the first step, the tie 1260 is folded over and the narrow end of the tie 1260 is inserted through the loop. The fold is such that that the narrow end of the folded tie 1260 does not extend beyond the wide end 1261. The tie 1260 is then positioned relative to the top cover 1240 such that the front face 1262 faces upward and the folded narrow end faces the wall 1242 of the top cover 1242 and then the wide end 1261 is fed through the slit 1244 and along the outer surface of the top cover 1240 until the end 1261 is located proximate one end of the top cover 1240. As the tie 1260 is fed through the slit 1244, it is folded over and laid flush against the outer surface of the wall 1242 of the top cover 1240 with the front face 1262 facing away from the wall 1242. In the position of FIG. 19, the rear face 1263 of the tie 1260 is not visible.

Figure 20:
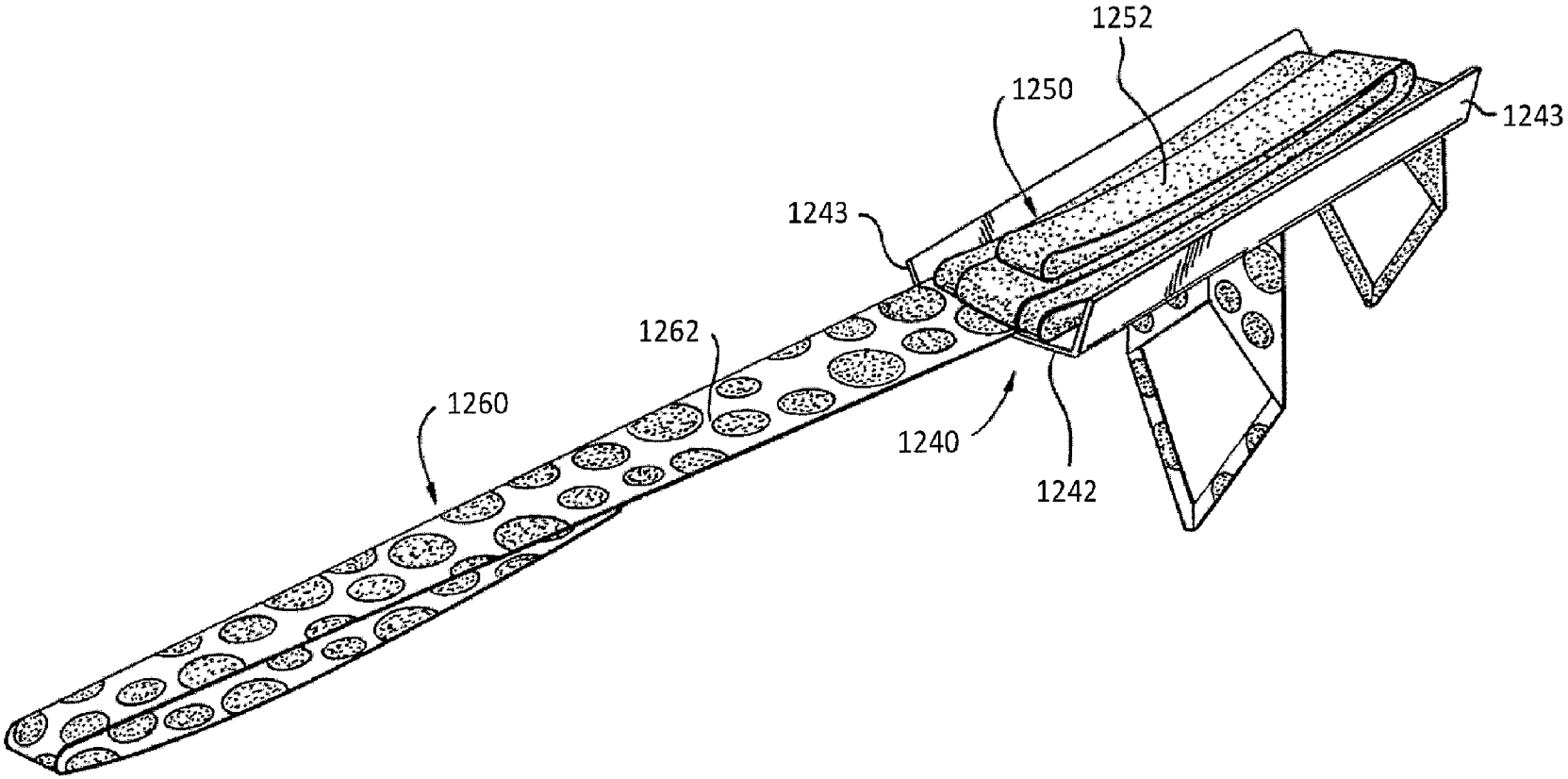
FIG. 20 is a rear elevation view of the top cover with the first tie being folded on top of itself.
Figure 22:
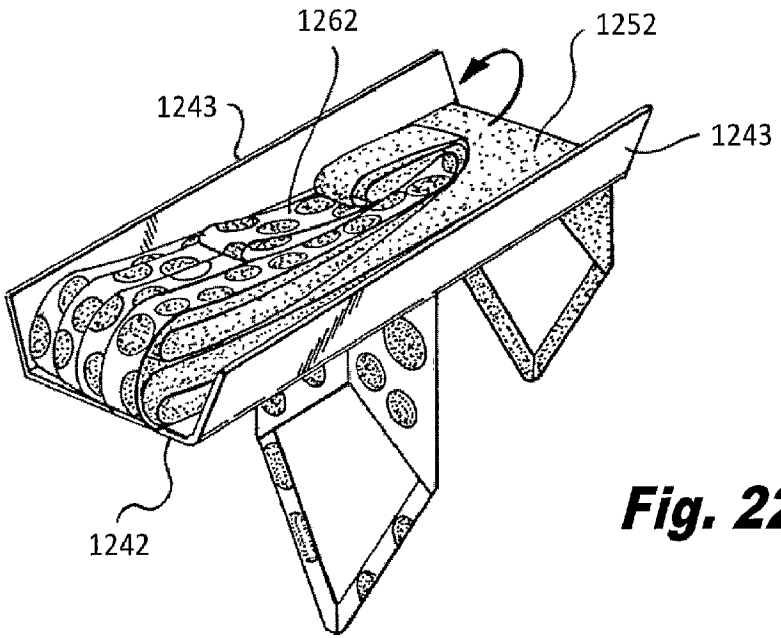
FIG. 22 is a rear elevation view of the top cover with the overlaying first and second folded ties being folded together a second time.
Figure 21:
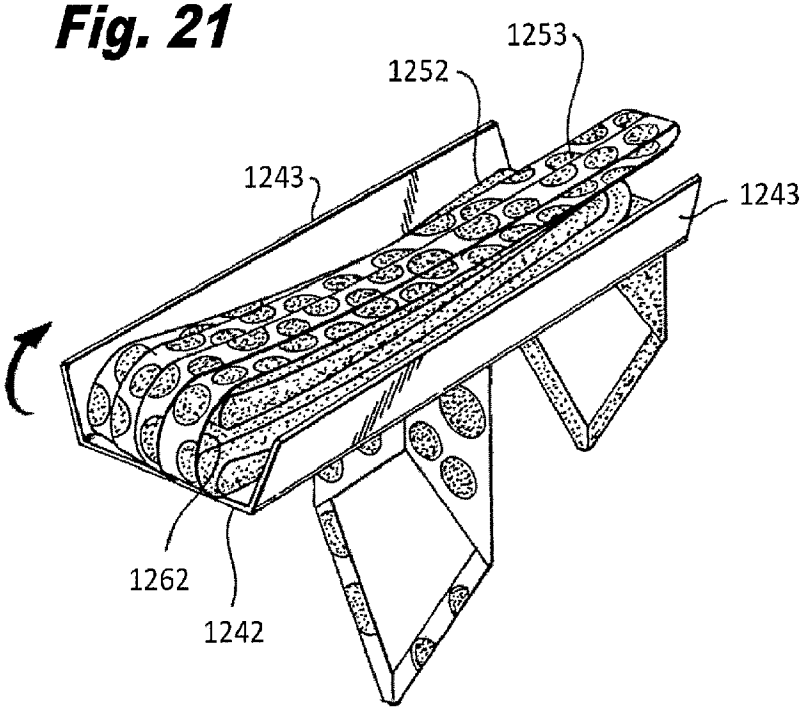
FIG. 21 is a rear elevation view of the top cover with the second tie being folded over on top of the folded first tie.

In FIG. 20, the tie 1250 is then folded several times on top of it self to reduce its length. In the folded position, a portion of the tie 1250 is disposed over the tie 1260 (front face 1262 thereof). In FIG. 21, the second tie 1260 is then folded over on top of itself and on top of the folded first tie 1250 so that the narrow folded ends of each tie 1250, 1260 over lie one another. In FIG. 22, the narrow ends of the overlying ties 1250, 1260 are then folded again resulting in a folded, nested tie structure where the ties 1250, 1260 are comingled and nested with one another and ties 1250, 1260 are contained within the top cover 1240 between the ends and sides 1243 thereof. In this way, the ties 1250, 1260 are at least partially nested within one another.

The nesting of the ties 1250, 1260 provides a number of advantages. For example, in the assembled state, the consumer sees the ties 1250, 1260 nicely separated from one another along the outer surface of the top cover 1240; however, underneath the top cover 1240, the ties 1250, 1260 are not separate from one another but are comingled. By nesting the ties, the ties 1250, 1260 have a reduced number of fold lines or creases and therefore are packaged in a more natural manner that results in the ties 1250, 1260 coming out of the box 1210 in better condition (a more wearable condition). Also, the space between the floor and the ceiling of the inner box 1210 is limited and therefore, the nesting of the ties 1250, 1260 saves space.

Alternatively, the ties 1250, 1260 can be maintained separately and simply rolled.

FIGS. 23 and 24 illustrate a box 1300 that includes an arrangement of articles of clothing. In particular, the box 1300 includes a first article of clothing 1310 and a second article of clothing 1320 that is complementary to the first article of clothing 1310 and is designed to be worn therewith. As with the other embodiment, all panels (walls) of the box 1300 can be formed of a transparent material or select panels thereof can be transparent. At least the front panel and typically also the rear panel of the box 1300 are transparent to allow a consumer to view the contents of the box. However, the sides and ends of the box 1300 can be opaque.

In the illustrated embodiment, the first article of clothing 1310 is in the form of a shirt (e.g., formal, dress or casual), that includes a collar 1312. Between the sides of the collar 1312 a space 1314 is formed. The second article of clothing 1320 is in the form of a tie that is disposed within the space 1314 for display to a consumer. For example, the tie 1320 can rolled or folded and contained within the space 1314 to allow a consumer to compare the tie 1320 to the shirt 1310. As shown, the tie 1320 can be rolled so that the pointed wide end 1321 of the tie 1320 is generally positioned the bottom region of the collar 1312 near the top button 1315 of the shirt 1310. The tie 1320 is thus securely held within the space 1314 and the shirt 1310 and tie 1320 can fit within the box 1300.

Figure 25:
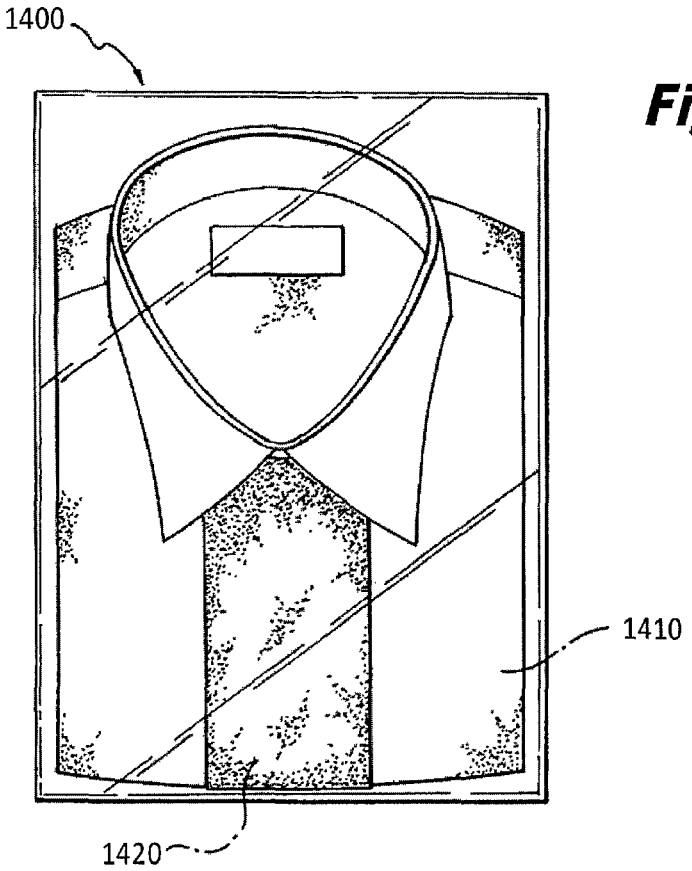
FIG. 25 is a front elevation view of a box including an arrangement of clothing articles according to an eleventh embodiment of the invention.
Figure 26:
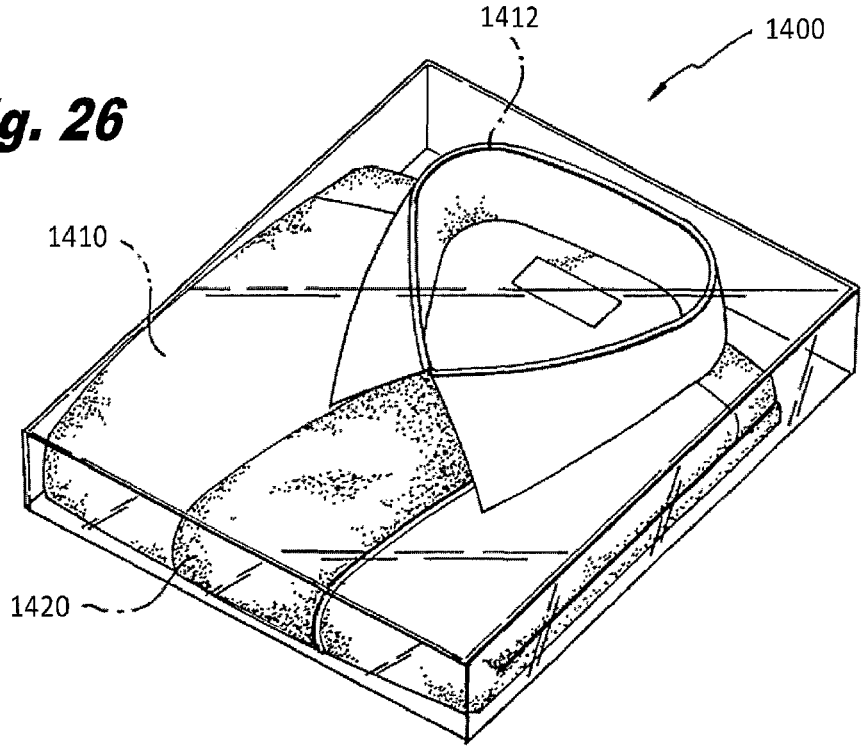
FIG. 26 is a front perspective view of the box of FIG. 25.

FIGS. 25 and 26 illustrate a box 1400 that includes an arrangement of articles of clothing. In particular, the box 1400 includes a first article of clothing 1410 and a second article of clothing 1420 that is complementary to the first article of clothing 1410 and is designed to be worn therewith. As with the other embodiment, all panels (walls) of the box 1400 can be formed of a transparent material or select panels thereof can be transparent. At least the front panel and typically also the rear panel of the box 1400 are transparent to allow a consumer to view the contents of the box. However, the sides and ends of the box 1400 can be opaque.

In the illustrated embodiment, the first article of clothing 1410 is in the form of a shirt (e.g., formal, dress or casual), that includes a collar 1412. The second article of clothing 1420 is in the form of a tie that is located along the shirt 1410 for display to a consumer. The tie 1420 is folded over along a fold line (e.g., the tie is folded in half such that the narrow pointed tip end is disposed proximate but not beyond the wide pointed tip end. The folded tie 1420 is then arranged such that it is tucked under the collar 1412 of the shirt 1410 with the fold line of the tie being positioned at the collar 1412. The tie 1420 is then folded underneath the shirt 1410 such that the wide pointed end is visible along the rear panel of the box 1400.

In this embodiment, the tie 1420 does not have a knotted look at the collar region but instead offers a tucked under the collar look.

Figure 27:
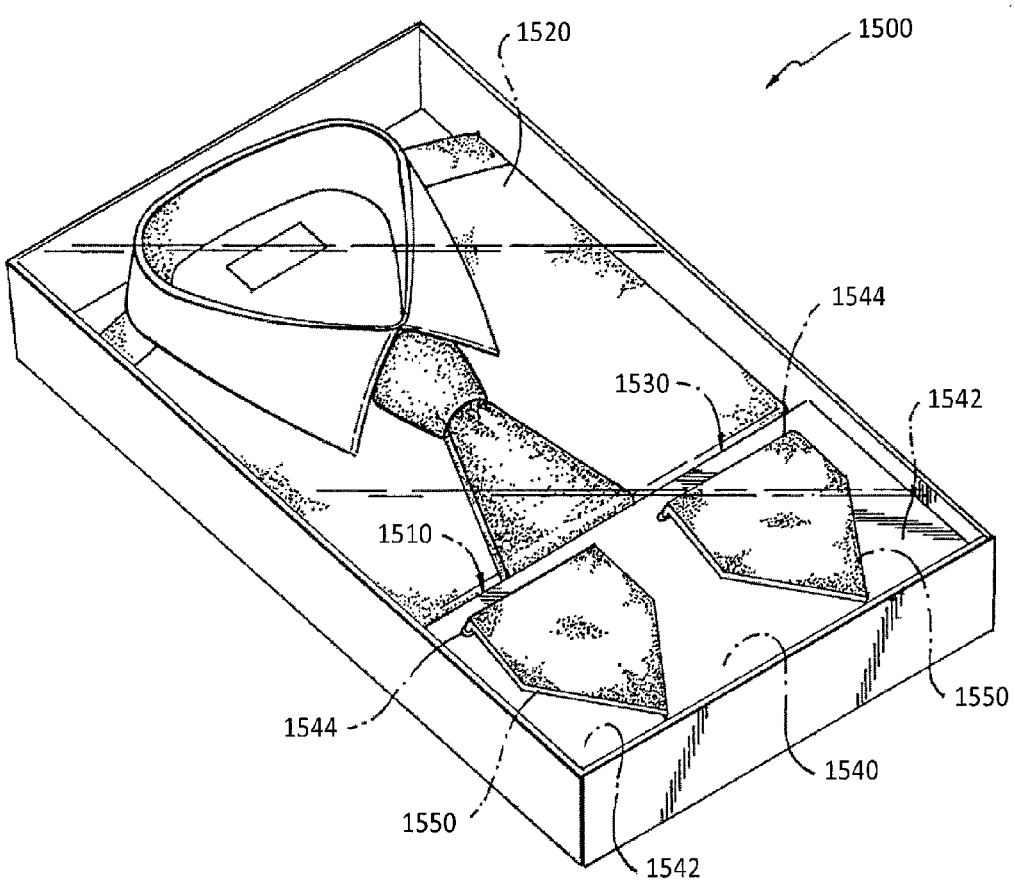
FIG. 27 is a perspective view of a box including an arrangement of clothing articles according to a twelfth embodiment of the invention.

FIG. 27 shows another box 1500 that includes an inner box 1510. As with the other embodiment, the inner box 1510 is received within an interior compartment of the box 1500 and serves to partition the interior compartment into two sections, one of which receives a first article of clothing 1520. All panels (walls) of the box 1500 can be formed of a transparent material or select panels thereof can be transparent. At least the front panel and typically also the rear panel are transparent to allow a consumer to view the contents of the box. However, the sides and ends of the box 1500 can be opaque. The inner box 1510 can be formed of a transparent material to allow the contents to be seen or the inner box 1510 can be formed of an opaque material, as in the case of when the inner box 1510 is made of a cardboard material.

Once again, any number of different articles of clothing can be used as the first article of clothing 1520. For example, the article of clothing 1520 can be in the form of a shirt (formal, dress or casual) as shown. The shirt 1520 is folded and received within the box 1500 adjacent the inner box 1510. Unlike previous embodiments disclosed herein, the inner box 1510 is located below or above the folded shirt 1520 as opposed to being located along one side of the shirt 1520 as in other embodiments. The shirt 1520 can include a tie as shown but it does not have to have one and instead can be packaged by itself.

The inner box 1510 has a base portion 1530 (similar to base portion 1230) that is open along one portion (e.g., front portion) to allow items to be received within an interior compartment of the box 1510. The base portion 1530 has a floor and opposing end walls and opposing side walls that extend upwardly therefrom to close off and define the interior compartment.

A top cover 1540 is received within the base portion 1530 to effectively close off the base portion 1530. The top cover 1540 has a center wall 1542 and two side walls or flaps that extend therefrom along a longitudinal length of the top cover 1540. The center wall 1542 defines the ceiling of the inner box 1510 when the top cover 1540 is received within the base portion 1530 and the side walls of the cover 1540 are disposed within the interior compartment of the inner box 1510 between the side walls thereof. When the top cover 1540 is inserted into the interior compartment of the inner box 1510, the side walls act as legs that support the top cover 1540 and allow it to stand therein. An empty space is thus formed between the wall 1542 (which acts as a ceiling of the inner box 1510) and the floor of the base portion 1530.

In accordance with one embodiment, the top cover 1540 is designed to allow a number of different items to be displayed and stored within the inner box 1510. For example, the wall 1542 of the top cover 1540 can include a pair of slits 1544 through which two ties 1550 extend. As shown, the wide end 1551 of each tie 1550 is positioned along the outer surface of the wall 1542 for display. The remaining portions of the ties 1550, 1560 are not in view but instead are located below the top cover 1540 within the interior compartment of the inner box 1510. In contrast to other embodiment, the ties 1550 are positioned side-by-side as opposed to a stacked relationship. Alternatively, the inner box 1510 can be located above the shirt 1520. The box 1510 can include V-shaped slits, as described above, which are spaced from slits 1544 and receive another portion of the tie 1550.

Figure 28:
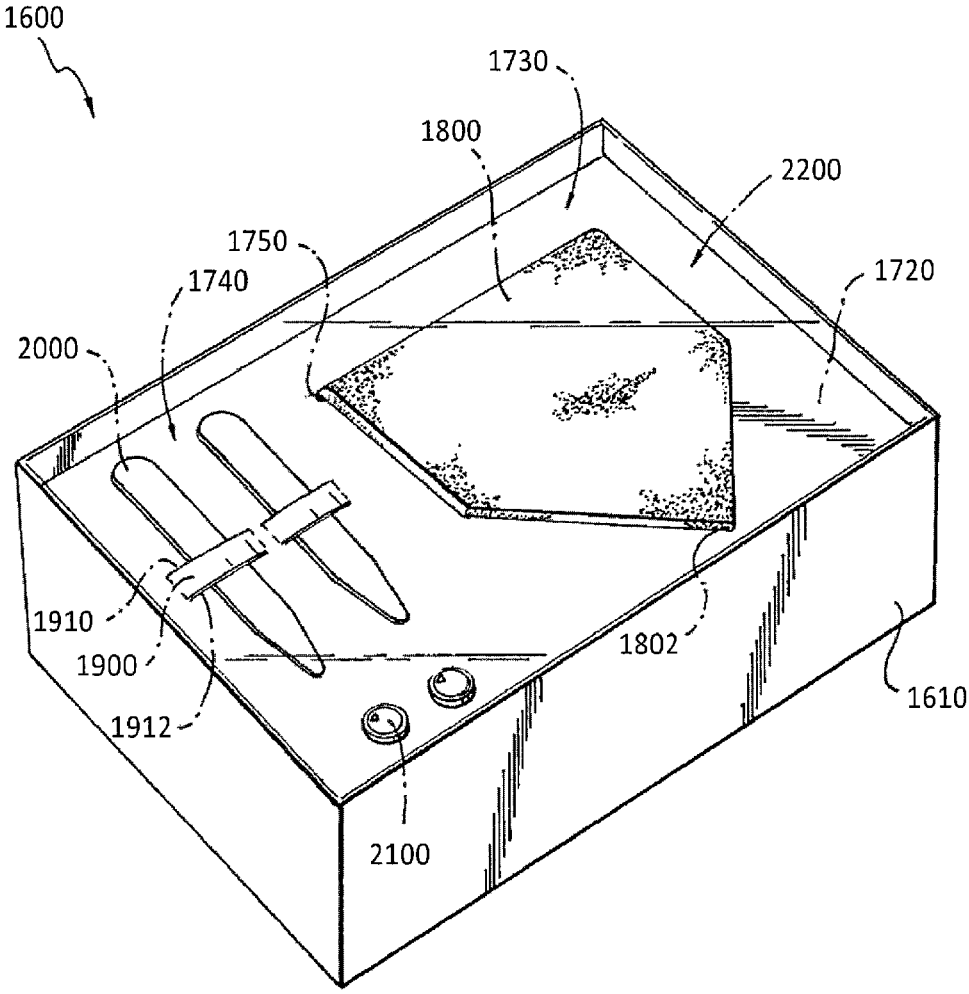
FIG. 28 is a perspective view of a box including a tie and collar stays arranged according to a thirteenth embodiment of the invention.

Now turning to FIG. 28, a display 1600 that includes a box 1610. The box 1610 is open along one face (top face) and is closed along the bottom, sides and ends as shown in FIG. 28. The box 1610 has a hollow interior in which contents are stored, in this case, articles of clothing and clothing accessories.

A display platform 1700 is disposed within the interior of the box 1610 and is a self-standing structure. The display platform 1700 can be a box-like structure formed of paper or it can include only a pair of side walls or end walls that are connected to a top wall 1720. In any event, the platform 1700 includes the top wall 1720 which supports the articles which are displayed in the box 1610. In its assembled upright condition, the height of the display platform 1700 is less than the height of the assembled box 1610 and therefore a space 1720 is formed between the top surface of the display platform 1700 and the top edge of the box 1610. While the display platform 1700 can be formed of paper (e.g., cardboard); however, other materials can be used.

The display platform 1700 includes a number of features that permit the display of an article of clothing and accessories. More specifically, the display platform 1700 includes a first region 1730 in which a tie 1800 is displayed and a second region 1740 which is adjacent the first region 1730 for displaying accessories. The display platform 1700 includes an opening 1750 that is in the form of a slit or the like that extends across the top wall 1720. The slit 1750 is a transverse opening that extends between the ends of the box. The slit 1750 has a width that permits the tie 1800 to extend therethrough. A majority of the tie 1800 is disposed underneath the top wall 1720 where it is stored. For example, the tie 1800 can be rolled or folded underneath the top wall 1720 with the wide pointed end 1802 of the tie 1800 being disposed through the slit 1750 such that the end 1802 is draped over and lies over the top wall 1720. This arrangement is shown in FIG. 28. The pointed end of the tie 1800 is thus displayed.

In the second region 1740, the display platform 1700 includes at least one and preferably a pair of integral locating and coupling members 1900. Each member 1900 is a bridge-like structure that is defined by a first slit 1910 and a spaced second slit 1912 with the member 1900 being defined therebetween. The slits 1910, 1912 are parallel to one another. The formation of slits 1910, 1912 permit the member 1900 to flex up, thereby exposing the underside of the member 1900. The members 1900 can also be referred to as being flat loops.

The flat loops 1900 are located side-by-side with respect to one another. The flat loops 1900 are designed to receive collar stays 2000. Each collar stay 2000 is coupled to and displayed along the top wall 1720 of the display platform 1700. A bottom pointed end 2010 of the collar stay 2000 is first inserted into the slit 1910 and then is directed under the flat loop 1900 and into the slit 1912 and then finally the bottom pointed end 2010 is disposed along the top wall 1720.

While a single collar stay 2000 is shown underneath the member 1900, it will be appreciated that a pair of collar stays 2000 can be disposed underneath the member 1900.

Other accessories 2100, such as jewelry (cuff links), can be displayed along the display platform 1700 as shown in FIG. 28. The accessories 2100 can be inserted into openings (holes) formed in the display platform 1700 that is formed in the second region below the collar stays 2000.

The display 1600 typically includes a top transparent cover 2200 that protects the contents of the display 1600. The cover 2200 includes a top surface that is displayed over the contents of the box 1610 and can include either end flaps/walls, side flaps/walls or both that serve to position and coupled the cover 2200 to the box 1610. The flaps can be positioned between the display platform 1700 and the walls of the box 1610 for coupling the cover 2200 to the box 1610.

In this manner, a retail display is provided where a tie and collar stays and other accessories are packaged in a display.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A retail display comprising:

a first box having walls that define a first interior compartment, the walls including a top wall that is formed of a transparent material to permit viewing of the first interior compartment;

an inner box that is open along a top thereof and is disposed within the first interior compartment; the inner box being dimensioned so that when the first box is in a closed position, the inner box is adjacent one side wall and two end walls of the first box and is fully contained within the first box, the inner box having a second interior compartment and a cover that is disposed within the inner box and extends across a floor of the inner box, the cover having a first slit and a second slit spaced from the first slit;

a first tie disposed within the second interior compartment with a portion thereof extending through the first slit so that a pointed end of the first tie is disposed across a top surface of the cover for display thereof, the pointed end being spaced from the second slit; and a second tie disposed within the second interior compartment with a portion thereof extending through the second slit so that a pointed end of the second tie is disposed across a top surface of the cover for display thereof, the pointed end of the second tie being spaced from one end of the inner box;

wherein the first and second ties are spaced from one another along the top surface of the cover; however, are intertwined and folded together underneath the top cover within the second compartment.

2. The retail display of claim 1, wherein the first tie is folded on top of itself and the second tie is folded on top of itself and at least a portion of a folded part of the first tie is folded about at least a portion of a folded part of the second tie.

3. The retail display of claim 1, wherein the inner box has a rectangular shape.

4. The retail display of claim 1, wherein the first and second slits are parallel to one another and formed between side walls of the cover.

5. The retail display of claim 4, wherein the side walls of the cover are sized so as to act as legs when the cover is inserted in the inner box, each side wall having a height that allows the first and second folded ties to be disposed between a floor of the inner box and an underside of the cover.

6. The retail display of claim 2, wherein the first and second ties are folded multiple times below the cover so as to form an intertwined layered tie structure.

7. The retail display of claim 1, wherein a height of a side wall of the inner box is selected to locate and limit movement of the shirt.

8. The retail display of claim 1, wherein the pointed ends of the first and second ties point in a same direction toward a front wall of the inner box.

* * * * *